US007328963B2

(12) United States Patent
Tajika et al.

(10) Patent No.: US 7,328,963 B2
(45) Date of Patent: Feb. 12, 2008

(54) INK JET PRINTING APPARATUS AND INK JET PRINTING METHOD

(75) Inventors: Hiroshi Tajika, Yokohama (JP); Hitoshi Nishikori, Inagi (JP); Daisaku Ide, Tokyo (JP); Takeshi Yazawa, Yokohama (JP); Atsuhiko Masuyama, Tokyo (JP); Akiko Maru, Kawasaki (JP); Satoshi Seki, Kawasaki (JP); Hirokazu Yoshikawa, Kawasaki (JP); Hideaki Takamiya, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 231 days.

(21) Appl. No.: 11/209,848

(22) Filed: Aug. 24, 2005

(65) Prior Publication Data

US 2006/0044342 A1 Mar. 2, 2006

(30) Foreign Application Priority Data

Aug. 30, 2004 (JP) ..... 2004-251080

(51) Int. Cl.
*B41J 29/393* (2006.01)
*B41J 29/38* (2006.01)
*B41J 23/00* (2006.01)

(52) U.S. Cl. ..... 347/19; 347/5; 347/37

(58) Field of Classification Search ..... 347/19
See application file for complete search history.

(56) References Cited

U.S. PATENT DOCUMENTS 4,712,909 A 12/1987 Oshikoshi
4,769,694 A 9/1988 Oshikoshi
5,633,663 A 5/1997 Matsubara et al.
6,193,358 B1 * 2/2001 Fujita et al. ..... 347/41
7,207,644 B2 * 4/2007 Kaburagi ..... 347/19

FOREIGN PATENT DOCUMENTS

| | | |
|---|---|---|
| JP | 62-41114 | 1/1987 |
| JP | 62-47290 | 2/1987 |
| JP | 5-15540 | 6/1993 |
| JP | 5-155040 | 6/1993 |
| JP | 5-278232 | 10/1993 |
| JP | 5-318770 | 12/1993 |
| JP | 7-285227 | 10/1995 |
| JP | 9-226175 | 9/1997 |
| JP | 9-226185 | 9/1997 |
| JP | 10-217436 | 8/1998 |

* cited by examiner

*Primary Examiner*—Matthew Luu
*Assistant Examiner*—Jannelle M. Lebron
(74) *Attorney, Agent, or Firm*—Fitzpatrick, Cella, Harper & Scinto

(57) ABSTRACT

The present invention allows for creating high quality images by coping with a variety of kinds of print mediums without having to prepare large-sized, large-capacity power supply and ink supply source. For this purpose, this invention detects the number of printing elements to be driven in a predetermined check area set in one scan area of the print head. If the detected value is greater than a predetermined threshold, either the number of printing elements to be driven in one scan period of the print head or one scan period from when the print head starts the printing scan until the next printing scan is started is selected and changed according to the set printing condition and the printing operation is performed accordingly.

14 Claims, 19 Drawing Sheets

INK JET PRINTING APPARATUS AND INK JET PRINTING METHOD

BACKGROUND OF THE INVENTION

1. Field of the Invention

The present invention relates to an ink jet printing apparatus and an ink jet printing method for printing an image by causing an ink ejection print head to scan in a direction crossing a print medium transport direction.

2. Description of the Related Art

As information processing devices such as personal computers proliferate in recent years, printing apparatus as an image forming terminal have also made rapid advance and come into widespread use. Of various printing apparatus, an ink jet printing apparatus is characterized by a construction in which ink is ejected from printing elements or nozzles onto a print medium, such as paper, cloth, plastic sheet and OHP sheet, to form an image on it. Since it employs a non-impact type printing system, the ink jet printing apparatus has many excellent features including an ability to perform the printing operation at low noise, at high resolution and at high speed, an ability to deal with a color printing with ease, and a low cost. Because of these advantages, the ink jet printing apparatus is now established as a mainstream printing apparatus for personal use.

The advance of the ink jet printing technology has been making improvements toward higher printed image quality, faster printing speed and lower image forming cost. Combined with proliferation of personal computers and digital cameras (including the ones that as single devices perform their functions and the ones that are integrated into other devices such as mobile phones), the progress in ink jet printing technology has made great contributions to the prevalence of the printing apparatus even among personal users. With the widespread use of the printing apparatus, there are growing calls also from personal users for further improvement of image quality. Particularly in recent years, users are demanding that photographs be able to be printed easily at home and that the printed images have a quality that matches a silver salt picture.

When compared with common silver salt pictures, images formed by the ink jet printing apparatus have a long-standing problem of graininess characteristic of the ink jet printing. A variety of measures to reduce this graininess have been proposed in recent years and there are many printing apparatus incorporating such measures. For example, there is an ink jet printing apparatus with an ink system which, in addition to the ordinary cyan, magenta, yellow and black inks, has light cyan and light magenta inks with lighter densities than the ordinary inks. In this ink system the use of light cyan and light magenta in areas with low densities can reduce graininess. In areas with high densities, using the ordinary cyan and magenta for printing can realize a wider color reproduction and smooth tonality.

Another proposed method involves reducing the size of dots formed on a print medium to reduce the graininess. For this purpose, a research is under way to reduce a volume of each ink droplet ejected from nozzles arrayed in a print head. In this case, not only reducing the volume of ink droplets but arranging a greater number of nozzles at smaller intervals can produce a high resolution image without slowing down the printing speed.

While the ink jet printing apparatus for personal use is required to print high quality images that match the quality of silver salt pictures, there are not a few occasions where ordinary documents including texts and tables are output. In printing documents, a greater importance is placed on a fast printing speed than on a high image quality that equals the silver salt pictures. Therefore, general ink jet printing apparatus are provided with a plurality of print modes so that the user can choose a desired print mode according to the kind of data being printed.

These ink jet printing apparatus have progressed in speed and image quality to meet the demands of the times and, as digital cameras become more widespread, the amount of data to be handled has also increased. One print image may have varying dot density distributions, including high duty areas and low duty areas, requiring varying amount of electricity and print data to drive a print head. To allow for a constant printing performance regardless of such electric power variations, circuits have to withstand a large capacity power supply, resulting in a printing apparatus itself becoming large in size and expensive.

In ordinary printing, there are very few pages of image that require constantly activating the largest number of nozzles arrayed in the print head. Even in one page of image, the area that is printed using the nozzles to the full capacity usually occupies only a part of it. To realize a low-cost, small printing apparatus, it is proposed to control a printing method according to the number of printed dots in a predetermined range. That is, the proposed method involves limiting the amount of electricity used in a predetermined length of time to assure a certain level of print quality even at locations where the image is printed at high duty while maintaining a high printing speed.

In Japanese Patent Publication No. 62-41114, for example, a printing apparatus is disclosed which counts a total number of dots and, when a predetermined value is exceeded, selects an appropriate printing speed to enable the printing of the largest number of dots.

Japanese Patent Application Laid-open No. 06-47290 discloses a method which, when a predetermined dot duty is exceeded in an area, prints that area in a plurality of divided passes.

Japanese Patent Application Laid-open No. 09-226185 discloses a method which divides a line buffer memory into segments and, when a print duty in any segment area exceeds a predetermined threshold, makes a decision as to whether a two-way printing or one-way printing is to be performed.

Japanese Patent Application Laid-open No. 09-226175 discloses a method which, as in Japanese Patent Application Laid-open No. 09-226185, checks if the print duty exceeds a predetermined value and, based on the check result, performs a dot-thinning printing.

Japanese Patent Application Laid-open No. 10-217436 discloses a method which introduces a divided control printing system capable of dividing a print area by considering characteristics of the nozzles and of utilizing not only a peak power but also a power supply as a whole at a maximum possible efficiency.

Further, Japanese Patent Application Laid-open No. 05-318770 discloses a method which changes a printing mode during the divided printing according to the kind of paper.

Further, Japanese Patent Application Laid-open No. 07-285227 discloses a method which, when a remaining volume of ink is small during the printing operation, checks image data to change the printing mode to an appropriate one.

However, the conventional ink jet printing apparatus described above may experience the following problems.

In the ink jet printing apparatus disclosed in Japanese Patent Publication No. 62-41114, there are occasions where a speed of a carriage mounting the print head and a drive frequency of the print head are lowered during the printing operation according to the number of dots to be formed. In that case, since in the ink jet system a dot landing position accuracy and the volume of ink ejected for one dot are influenced by the carriage speed and the drive frequency, an area printed at low speed and an area printed at normal speed have different densities or gradation levels, resulting in density variations on a printed image. Such density variations, though they may be adjusted by an ejection volume control, will lead to a complex construction of the printing apparatus. Thus, the technique disclosed in this publication is difficult to apply to low-cost printers.

In the ink jet printing apparatus disclosed in Japanese Patent Publication No. 06-47290, when a print medium is used which exhibits relatively sharp density changes in dot overlapping portions, harmful effects, such as density variations and seam lines, are produced on the printed image depending on how ink dots overlap one another.

If the printing mode is limited to the two-way or one-way printing as in Japanese Patent Application Laid-open No. 09-226185, the appearance of color may change from one ink application order to another depending on the print medium used, degrading an image quality.

In Japanese Patent Application Laid-open No. 09-226175, since the printing is done by thinning print data, an originally intended image cannot be formed.

Japanese Patent Application Laid-open No. 10-217436 discloses a method that introduces a divided control printing system capable of dividing a print area by considering characteristics of the nozzles and of utilizing not only a peak power but also a power supply as a whole at a maximum possible efficiency. However, if a high speed printing is performed by using a recently introduced print head made up of 512 small nozzles each ejecting fine droplets of 5 pl or less and arrayed at narrow pitches of 1200 dpi or less, the following problem will surface. A so-called end nozzle dot deflection becomes notable, a phenomenon in which the ink droplets ejected from the nozzles at the ends of the print head are deflected by an air flow and land on positions deviated toward a central portion of the head. A simple divided printing alone, however, cannot prevent this end nozzle dot deflection from producing white lines significantly degrading the image quality.

Japanese Patent Application Laid-open No. 05-318770 discloses a method which performs a divided printing by limiting the print head scan direction to only one direction for a special print medium and, for plain paper, performs the divided printing in two directions. However, the inventors of this invention have found that if the divided printing is performed on the special print medium by thinning print data, only a band area that was subjected to the divided printing has a different density, a so-called band variation phenomenon. It is therefore not preferable to apply the divided printing described in the above reference to the printing of picture image that places greater importance on the tonality.

Further, Japanese Patent Application Laid-open No. 07-285227 discloses a method which, when an ink volume remaining in an ink tank is running low during the printing operation, checks if the data to be printed is characters or image and, if it is decided to be characters, allows the printing operation to be continued to the end. However, this reference does not give any descriptions on the relation between the ink remaining volume or ink flow volume and the divided printing method.

SUMMARY OF THE INVENTION

The present invention can provide an ink jet printing apparatus and an ink jet printing method which can form high quality images by coping with a variety of kinds of print mediums and minimizing a reduction in throughput, without requiring special, large-sized, large-capacity power supply and ink supply source even when densely arrayed nozzles are used.

According to a first aspect, this invention provides an ink jet printing apparatus having a scan means for causing a print head to scan in a predetermined scan direction, the print head having a plurality of printing elements to convert an electric energy into an ink ejection energy, and a transport means for transporting a print medium in a direction crossing the scan direction of the print head, the ink jet printing apparatus comprising: drive means for driving a plurality of printing elements of the print head; setting means for setting a printing condition of a printing operation; operation number detection means for detecting the number of printing element operations executed by the drive means in a predetermined check area set in one scan area of the print head; decision means for checking if a detected value produced by the operation number detection means is larger than a predetermined threshold; first changing means for changing a set value of the number of printing element operations in one scan period of the print head; second changing means for changing one scan period from when the print head starts the printing scan until the next printing scan is started; and control means for, when the decision means decides that the detected value is larger than the threshold, selecting either the first changing means or the second changing means according to the printing condition set by the setting means and causing the printing operation to be executed.

According to a second aspect, this invention provides an ink jet printing method that performs printing by using a print head having an array of printing elements to convert an electric energy into an ink ejection energy, driving the printing elements as the print head scans in a predetermined scan direction and transporting a print medium in a direction crossing the scan direction of the print head, the ink jet printing method comprising: a driving step of driving a plurality of printing elements of the print head; a setting step of setting a printing condition of a printing operation; a operation number detecting step of detecting the number of printing element operations executed by the driving step in a predetermined check area set in one scan area of the print head; a decision step of checking if a detected value produced by the operation number detecting step is larger than a predetermined threshold; a first changing step of changing a set value of the number of printing element operations in one scan period of the print head; a second changing step to change one scan period from when the print head starts the printing scan until the next printing scan is started; and a control step to, when the decision step decides that the detected value is larger than the threshold, select either the first changing step or the second changing step according to the printing condition set by the setting step and causing the printing operation to be executed.

According to a third aspect, this invention provides an ink jet printing apparatus having a scan means for causing a print head to scan in a predetermined scan direction, the print head having a plurality of printing elements to convert an electric energy into an ink ejection energy, and a transport means f or transporting a print medium in a direction crossing the scan direction of the print head, the ink jet printing apparatus comprising: power supply means for generating an electric energy to be supplied to the printing elements of the print head; drive means for driving a plurality of printing elements of the print head by supplying the electric energy from the power supply means to the printing elements; setting means for setting a printing condition of a printing operation; operation number detection means for detecting the number of printing element operations executed by the drive means in a predetermined check area set in one scan area of the print head; decision means for checking if a detected value produced by the operation number detection means is larger than a predetermined threshold; first changing means for changing a set value of the number of printing element operations in one scan period of the print head; second changing means for changing one scan period from when the print head starts the printing scan until the next printing scan is started; and control means for, when the decision means decides that the detected value is larger than the threshold, selecting either the first changing means or the second changing means according to the printing condition set by the setting means and causing the printing operation to be executed.

According to a fourth aspect, this invention provides an ink jet printing apparatus having a scan means for causing a print head to scan in a predetermined scan direction, the print head having a plurality of printing elements to convert an electric energy into an ink ejection energy, and a transport means for transporting a print medium in a direction crossing the scan direction of the print head, the ink jet printing apparatus comprising: an ink supply source for supplying ink to the printing elements of the print head; drive means for driving a plurality of printing elements of the print head; setting means for setting a printing condition of a printing operation; ink volume detection means for detecting an ink volume to be ejected in a predetermined check area set in one scan area of the print head, according to the number of printing element operations executed by the drive means in the check area; decision means for checking if a detected value produced by the ink volume detection means is larger than a predetermined threshold determined by an ink supply capability of the ink supply source; first changing means for changing a set value of the number of printing element operations in one scan period of the print head; second changing means for changing one scan period from when the print head starts the printing scan until the next printing scan is started; and control means for, when the decision means decides that the detected value is larger than the threshold, selecting either the first changing means or the second changing means according to the printing condition set by the setting means and causing the printing operation to be executed.

In this invention, when the number of nozzle operations or ink ejection volume in a predetermined check area set in one scan area exceeds a predetermined threshold, either a printing control to change the number of nozzles to be driven in one scan period of the print head or a printing control to change one scan period from when the print head starts the printing scan until the next printing scan starts is selected according to the printing condition such as the kind of print medium and the printing operation is performed accordingly. Thus, even when densely arrayed nozzles are used, no special, large-sized, large-capacity power supply and ink supply source are required. It is therefore possible to keep the throughput low and still form high quality images in a variety kinds of print mediums.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Now, embodiments of this invention will be described in detail by referring to the accompanying drawings.

First Embodiment

Mechanical Construction

Figure 1:
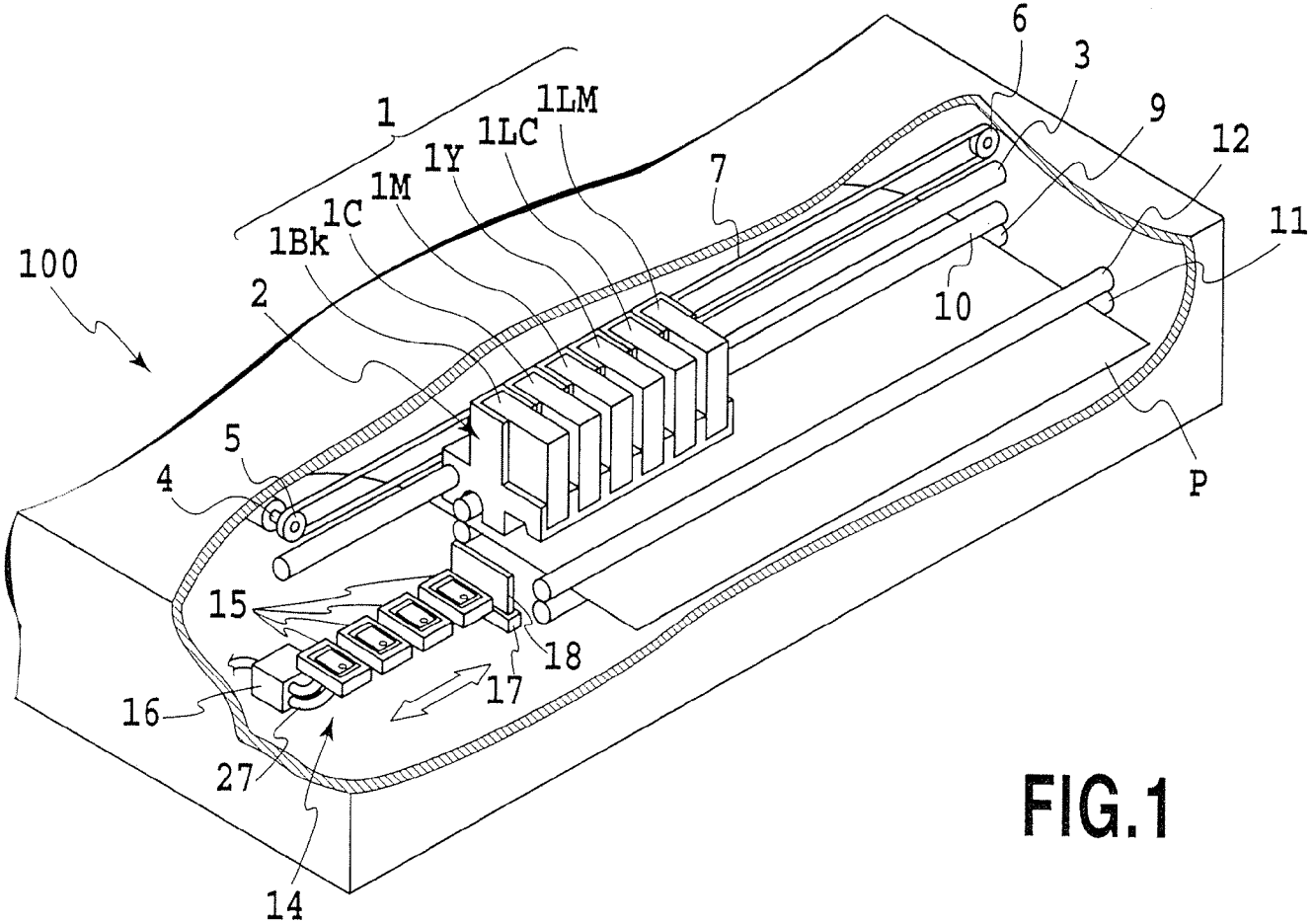
FIG. 1 is a perspective view showing a mechanical construction of an ink jet printing apparatus applied to one embodiment of this invention.

FIG. 1 is a perspective view showing a mechanical construction of an ink jet printing apparatus applied to the first embodiment of this invention.

In the figure a printing unit that performs a printing operation on a print medium includes a plurality (in this example, six) of head cartridges 1Bk, 1C, 1M, 1Y, 1LC, 1LM and a carriage 2 that replaceably carries these head cartridges and performs a reciprocal movement. These head cartridges each have a print head 13 which has a nozzle array consisted of a plurality of nozzles and an ink tank. The print head 13 is provided with a connector to receive a signal for driving the print head. In the following description, all or any one of the head cartridges 1Bk, 1C, 1M, 1Y, 1LC, 1LM is represented simply by a head cartridge 1.

Of these head cartridges 1, 1Bk, 1C, 1M, 1Y, 1LC, 1LM eject different color inks. Ink tanks mounted on each head cartridge accommodate coloring inks, such as black (Bk), cyan (C), magenta (M), yellow (Y), light cyan (LC) and light magenta (LM), respectively.

These head cartridges are replaceably mounted at predetermined positions on the carriage 2. The carriage 2 is provided with a connector holder (electric connector) to transfer a drive signal etc. through the connectors to the individual head cartridges 1.

The carriage 2 is movably supported on a guide shaft 3 installed in the printing apparatus body and extending in a main scan direction so that it can be reciprocally moved in the main scan direction. The carriage 2 is reciprocally driven by a main scan motor 4 through a drive mechanism such as motor pulley 5, follower pulley 6 and timing belt 7. The movement and position of the carriage 2 are controlled by a control system described later.

A print medium 8 such as paper and thin plastic sheet is transported by the rotation of two sets of transport rollers 9, 10 and 11, 12 to pass through an area (printing area) opposing nozzle faces of the head cartridges 1. The print medium 8 is supported at its back on a platen (not shown) so that in the printing area it forms a flat print surface. The head cartridges 1 mounted on the carriage 2 are held so that their nozzle faces protrude downward from the carriage 2 and are parallel to the print medium 8 held between the two sets of transport rollers 9, 10 and 11, 12.

Figure 2:
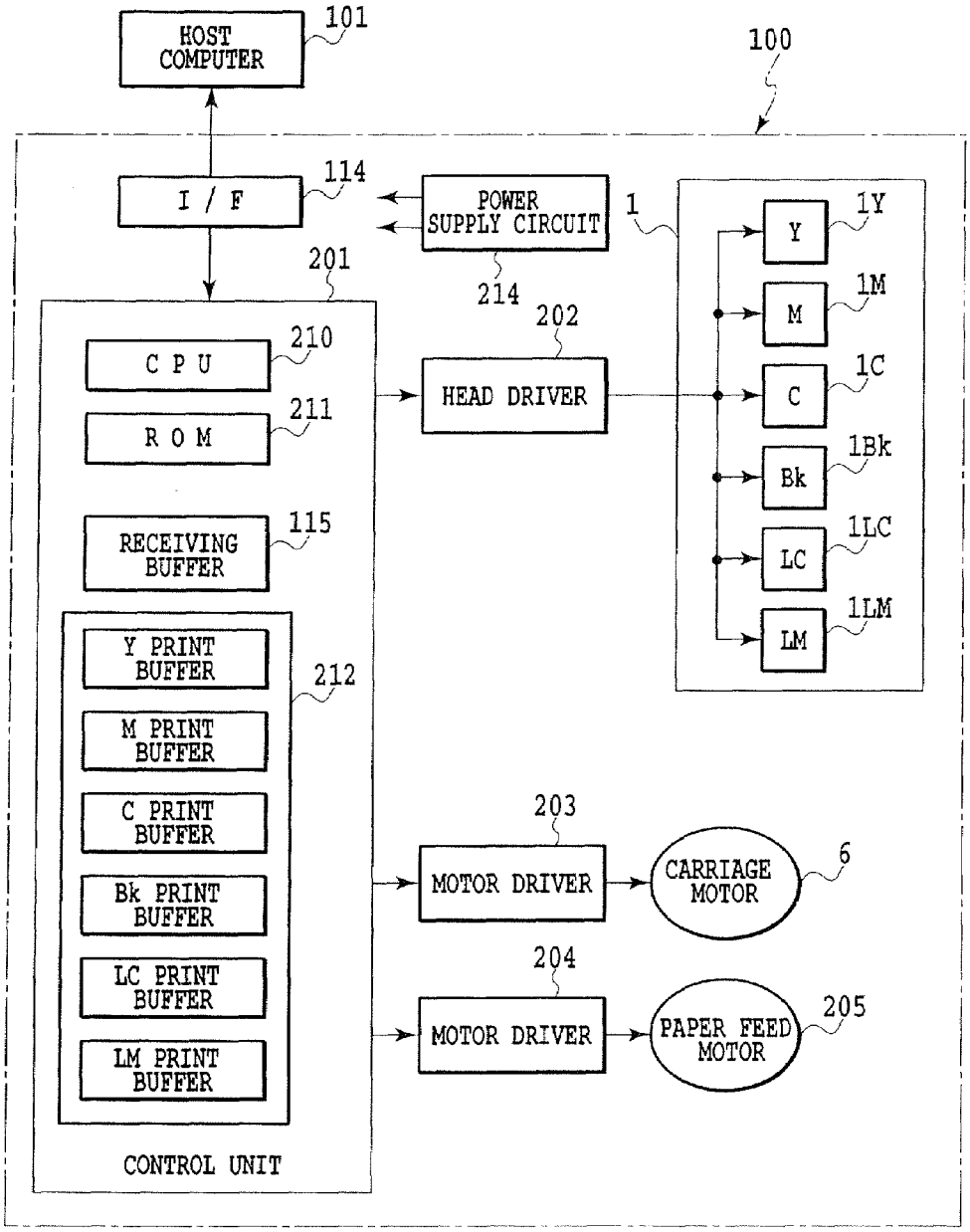
FIG. 2 is a block diagram showing an outline configuration of a control system of the ink jet printing apparatus in the embodiment of this invention.

Each of the above head cartridges 1 is an ink jet head cartridge that makes use of a thermal energy in ejecting ink. In each nozzle of the ink jet cartridge 1, an electrothermal transducer is installed to generate the thermal energy which is used to eject ink. More specifically, the printing portion of the head cartridge 1 converts an electric energy applied to the electrothermal transducer in each nozzle into a thermal energy. The heat thus generated causes a film boiling in ink, forming a bubble A pressure of the bubble as it expands ejects an ink droplet from the nozzle, which then lands on the print medium to form an image. In this specification and the scope of claim, the word nozzle is meant to include an ink path having an ink ejection port from which ink is ejected, and the electrothermal transducer installed in the path Control System Next, an outline configuration of a control system of the ink jet printing apparatus in the first embodiment of this invention will be explained by referring to FIG. 2.

In the figure, reference number 101 represents a host computer connected to the ink jet printing apparatus 100 through an interface 114. The host computer 101 stores a printer driver that creates image information and control information to cause the printing apparatus 100 to perform a printing operation.

Denoted 214 is a power supply unit to supply electricity to various parts of the ink jet printing apparatus 100. Designated 201 is a control unit to perform various processing described later, such as calculation, decision making, control and coefficient determination. The control unit 201 includes a CPU 210 such as microprocessor, a ROM 211 storing control programs to be executed by the CPU 210 and data, and a RAM 212 used as a work area by the CPU 210 when executing various processing and also used to temporarily hold data. The RAM 212 is provided with a receiving buffer 115 that temporarily stores received print data. The RAM 212 also has Y, M, C, Bk, LC and LM printer buffers that store print data for individual color inks Y, M, C, Bk, LC, LM read out from the receiving buffer 115 and supply these print data to the associated print heads 1Y, 1M, 1C, 1Bk, 1LC, 1LM.

Denoted 202 is a head driver (head driving means) that supplies the electric energy from the power supply unit 214 to the print head. According to the print data output from the control unit 201, the head driver activates the yellow print head 1Y, magenta print head 1M, cyan print head 1C, black print head 1Bk, light cyan print head 1LC and light magenta print head 1LC. Designated 203 and 204 are motor drivers which activate the corresponding carriage motor 6 and paper feed motor 205.

Denoted 214 is the power supply unit 214 to supply electricity to various parts of the ink jet printing apparatus.

Image Processing

Figure 3:
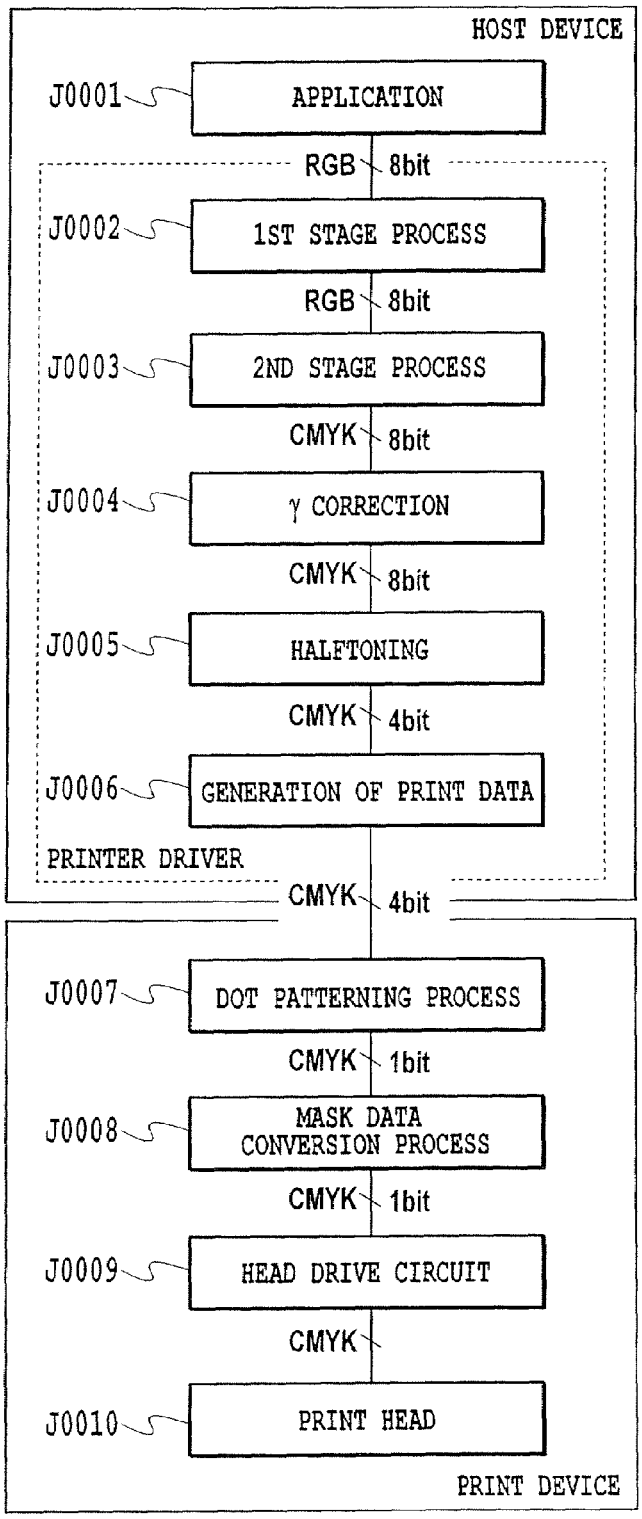
FIG. 3 is a block diagram showing a flow of an image data conversion process in the embodiment of this invention.

FIG. 3 is a block diagram showing a flow of image data conversion process in this embodiment.

The ink jet printing apparatus applied in this embodiment performs a printing operation using light cyan and light magenta inks as well as basic color inks of cyan, magenta, yellow and black. Thus, six print heads are provided, one for each of the six color inks. As shown in FIG. 3, a sequence of steps making up the image data conversion process is executed by the printing apparatus and a personal computer as the host device.

Among programs running on an operating system of the host device are an application and a printer driver. The application J0001 generates image data to be printed by the printing apparatus. During actual printing, image data generated by the application is transferred to the printer driver.

In the printing apparatus of this embodiment, the user can choose a desired print mode from the printer driver. In this embodiment at least two print modes, a high quality picture mode and a high speed mode, are available. In the sequence of steps, the processing downstream of the printer driver operation can be designed specifically to each of the different print modes to some degree.

First, a sequence of steps executed during the high quality picture mode will be explained.

The printer driver in this embodiment has a function of executing precedent process J0002, subsequent process J0003, γ correction J0004, half toning J0005 and print data creation J0006. These processes are briefly explained here. The precedent process J0002 performs mapping of a gamut.

The precedent process J0002 performs data conversion to map the gamut reproduced by image data R, G, B of sRGB standard into a gamut reproduced by the printing apparatus. More specifically, 8-bit data for R, G and B is converted into 8-bit data of different content by using a three-dimensional LUT.

The subsequent process J0003, based on the data R, G, B that has undergone the gamut mapping, determines color separation data for Y, M, C, K, LC and LM that matches combinations of inks that reproduce colors represented by the gamut-mapped RGB data. Here, as in the precedent process, an interpolation calculation is also performed using the three-dimensional LUT.

The γ correction J0004 performs a gradation value conversion on the color separation data obtained by the subsequent process J0003 for each color. More specifically, the gradation value conversion is done by using a one-dimensional LUT corresponding to the tonal characteristic of each color ink of the printing apparatus so that the color separation data can be linearly matched to the tonal characteristic of the printing apparatus.

The half toning J0005 performs a quantization to convert 8-bit color separation data Y, M, C, K, LC, LM into 4-bit data. In this embodiment, 256-gradation 8-bit data is converted into 9-gradation 4-bit data by using an error diffusion method This 4-bit data will become an index indicating a pattern in the dot arrangement patterning process in the printing apparatus.

The last processing performed by the printer driver involves creating print data which is print control Information added to the print image data of the 4-bit index data.

The printing apparatus performs the dot patterning process J0007 and mask data conversion process J0008 on the incoming print data.

In the following, we will describe the dot patterning process J0007 of this embodiment during the high quality mode. In the half toning process described above, the number of gradation levels is reduced from 256 gradation levels (8-bit data) to 9 gradation levels (4-bit data), However, the information that can actually be printed by the ink jet printing apparatus of this embodiment is binary information, i.e., whether ink is ejected or not. The dot patterning process transforms the multi-level data 0-8 to two-level data that determines the presence or absence of a dot. More specifically, to each pixel represented by the 4-bit data of level 0-8 output from the half toning process, the dot patterning process J0007 assigns a dot pattern corresponding to the gradation level (0-8) of that pixel. That is, dot-on or dot-off is defined at each of a plurality of element areas making up one pixel by putting 1-bit ejection data, "1" or "0", in each pixel element area.

Figure 4:
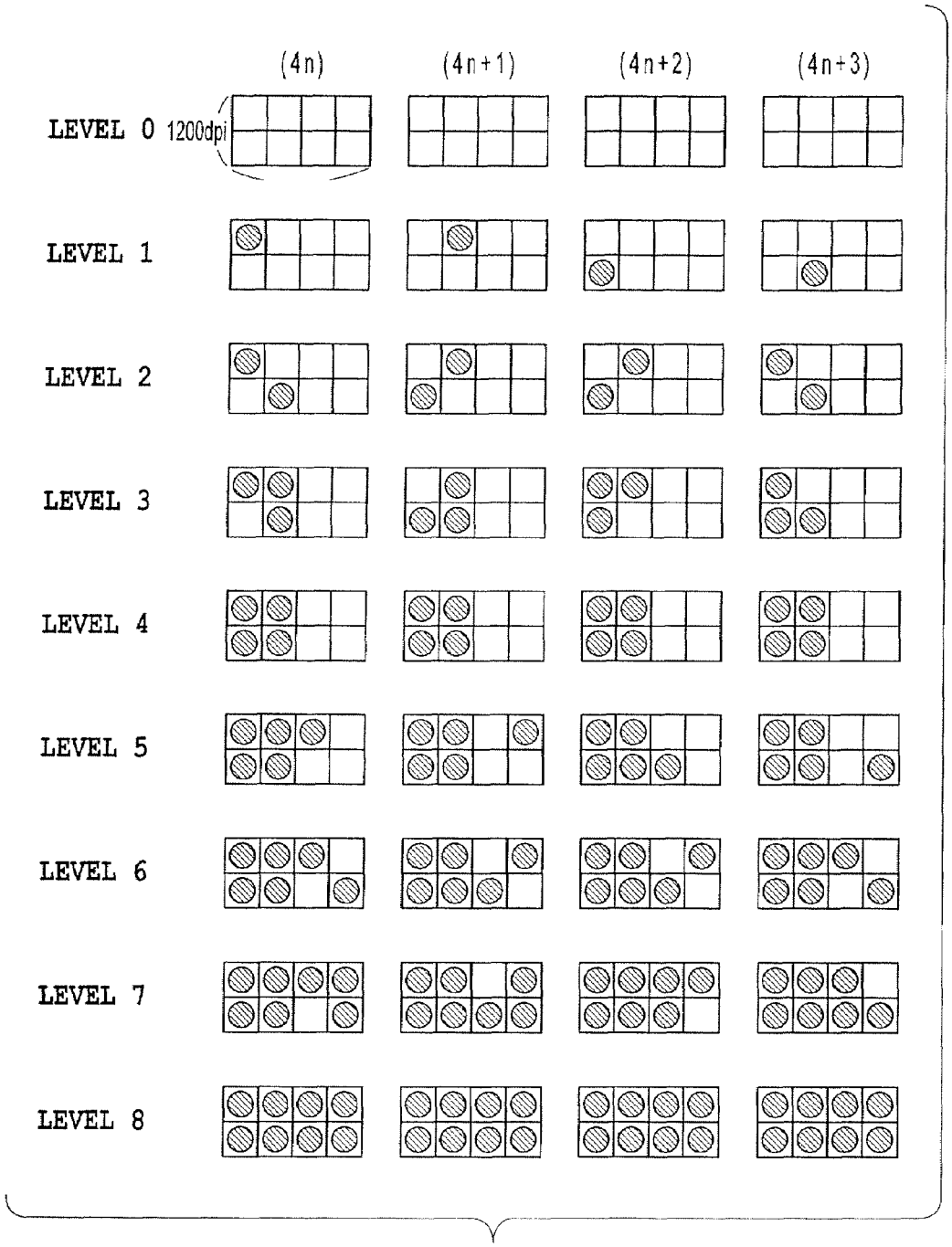
FIG. 4 illustrates a dot patterning process performed during a high quality mode in the embodiment of this invention, showing output patterns for input levels 0-8.

FIG. 4 shows output dot patterns into which the dot patterning process of this embodiment has transformed the input levels 0-8 during the high quality mode. The level values shown at left in the figure correspond to level 0 to level 8 output from the half toning process. The areas each made up of 2×4 pixel elements shown at right correspond in size to one pixel output from the half toning process, and are arranged at 600 ppi (pixels/inch; reference value) in both vertical and horizontal directions. The pixel elements are minimum unit areas, for each of which the dot-on or dot-off is defined, and are arranged at 1200 dpi (dots/inch; reference value) in a vertical direction and at 2400 dpi in a horizontal direction. The printing apparatus of this embodiment is designed so that one ink droplet of 2 pl is applied to one pixel element measuring about 20 μm in the vertical direction and about 10 μm in the horizontal direction, which obtains the predetermined dot densities.

In FIG. 4, the vertical direction represents the direction in which ink ejection ports of the print head are arrayed, with the pixel element arrangement density matching the ink ejection ports arrangement density at 1200 dpi. The horizontal direction represents the direction in which the print head is scanned. In the high quality picture mode of this embodiment, the print head prints at 2400 dpi in the horizontal direction.

Further, in the figure, pixel element areas marked with a circle are areas where a dot is to be formed. As the level increases, the number of dots printed in one pixel also increases one by one.

(4n) to (4n+3) with n substituted by an integer more than 1 represent pixels arranged in the horizontal direction from the left end of an input image. Dot patterns shown below them indicate that even for the same input levels different patterns are prepared for printing at different pixel positions. That is, if the same input levels are received, the four different dot patterns shown at (4n) to (4n+3) are cyclically assigned to different positions on the print medium. This arrangement produces an effect of being able to distribute the number of ejections between the nozzles located at an upper tier of the dot pattern and the nozzles located at a lower tier of the dot pattern and to scatter various noise characteristic of the printing apparatus.

In the high quality picture mode of this embodiment, the density information on the original image is processed in the manner described above. At the end of the dot patterning process, all dot patterns on the print medium are determined.

Now, the mask data conversion process J0008 in the high quality picture mode will be explained.

Since the presence or absence of dot in each pixel element on the print medium is determined by the dot patterning process, a desired image can be printed by supplying this information to the print head drive circuit. However, the ink jet printing apparatus normally employs a multipass printing method.

The multipass printing method is briefly explained as follows.

Figure 5:
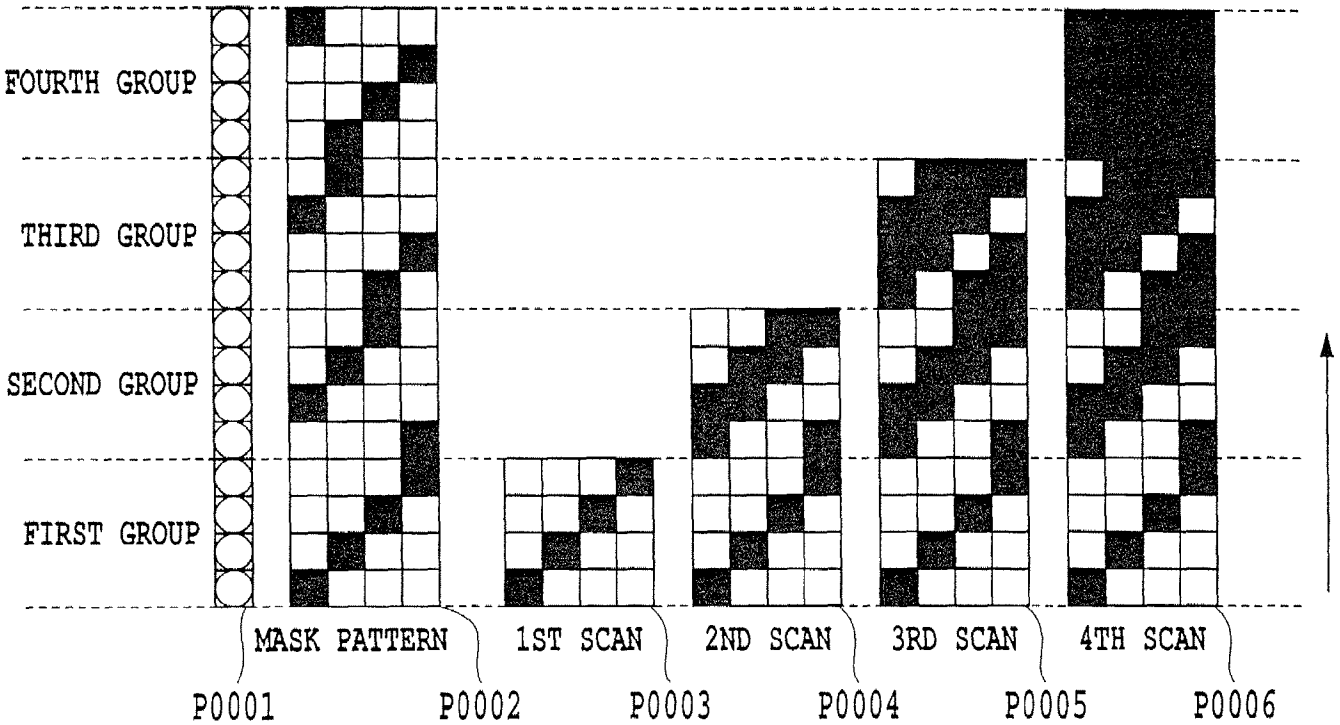
FIG. 5 schematically illustrates a print head and printed patterns, explaining how a multipass printing is performed in the embodiment of this invention.

FIG. 5 schematically shows a print head and printed patterns for the explanation of the multipass printing method. P0001 represents the print head. Here, it is shown to have only 16 nozzles for ease of explanation. The nozzles are divided into four groups, first to fourth nozzle group, each having four nozzles as shown in the figure. P0002 represents a mask pattern in which those pixel elements that are to be printed with the associated nozzles are painted black. The mask patterns for these nozzle groups are complementary to one another. That is, superimposing the patterns printed by the individual nozzle groups completes a final printed area of 4×4 pixel elements.

Patterns denoted P0003-P0006 show how an image is formed by repeating the printing scan After each printing scan is finished, the print medium is fed one nozzle group width in the direction of arrow in the figure. Therefore, the same area of the print medium (horizontal band area corresponding to the one nozzle group width) undergoes four printing scans before the image in that area is completed. Forming an image in each area of the same width on the print medium by performing a plurality of scans of different nozzle groups on the same area, as described above, reduces adverse effects of nozzle variations and variations in print medium feeding accuracy.

Figure 6:
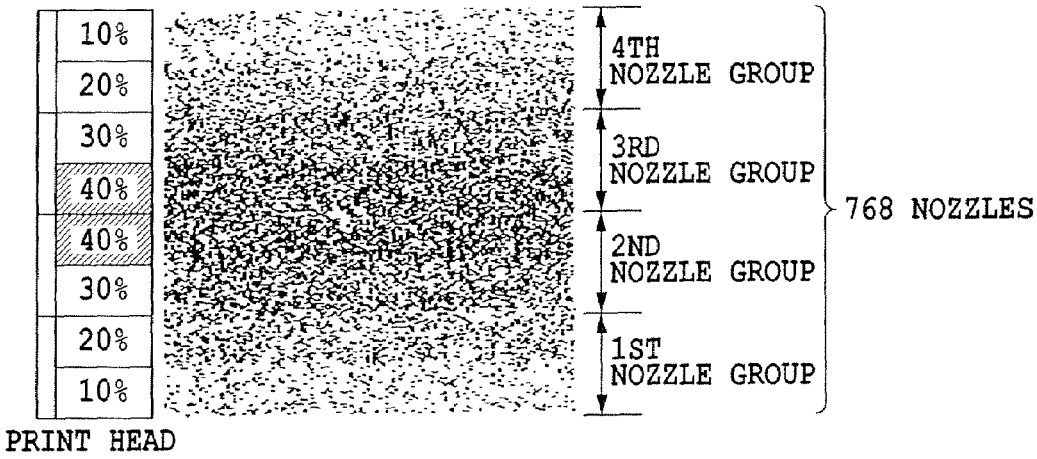
FIG. 6 illustrates a mask pattern actually applied to a high quality picture mode in the embodiment of this invention.

FIG. 6 shows a mask pattern actually applied in the high quality picture mode of this embodiment. The print head J0010 used in this embodiment has 768 nozzles. In the high quality picture mode, a 4-pass printing is performed as in FIG. 5. Therefore, each of the four nozzle groups has 192 nozzles. The mask pattern has a size measuring 768 pixel elements in the vertical direction, equal to the number of nozzles, and 256 pixel elements in the horizontal direction. The mask pattern is so arranged that the four nozzle groups complement one another.

In the ink jet print head that ejects a large number of small ink droplets at high frequency, such as one used in this embodiment, it is known that an air flow is produced near the printing portion during the printing operation and influences the direction in which ink is ejected from those nozzles situated at the end portions of the print head. Thus, as can be seen from FIG. 6, in the mask pattern for the high quality mode of this embodiment, a print duty distribution is deviated among the nozzle groups and also among different areas in each nozzle group. As shown in FIG. 6, by applying a mask pattern so arranged as to make the print duty for the nozzles situated at the ends lower than the central nozzles, it is possible to make less noticeable degradations in print quality caused by landing position deviations of ink droplets ejected from the end nozzles.

In this embodiment the mask data shown in FIG. 6 and a plurality of pieces of mask data to be applied in other print modes are stored in memory in the printing apparatus. In the mask data conversion process, the mask data and the output signal from the dot patterning process are ANDed to determine pixels to be printed in each printing scan. Then, data representing pixels to be printed and those not to be printed is fed as an output signal to the drive circuit J0009 of the print head J0010.

The 1-bit data for each color supplied to the drive circuit J0009 is converted into a drive pulse for the print head J0010 and the print head ejects ink at predetermined timings.

It is assumed that the dot patterning process and the mask data conversion process in the printing apparatus are executed by dedicated hardware circuits under the control of the CPU making up the control unit of the printing apparatus.

Next, the processing performed during a high speed mode in this embodiment will be explained. Although the explanation of the high speed mode may be made by also referring to the processing flow shown in FIG. 3, it should be noted that the high speed mode of this embodiment uses only four basic color inks, cyan, magenta, yellow and black, to speed up the processing. So, the subsequent process J0003 converts RGB 8-bit data into CMYK 8-bit data so that the subsequent processing performs their operations on the data of four colors C, M, Y and K.

The half toning J0005, as in the high quality picture mode, performs a quantization which converts 8-bit color separation data into 4-bit data. In the high speed mode, however, 256-gradation 8-bit data is converted into 5-gradation 4-bit data by using a multi-valued dither pattern without using the error diffusion method. That is, the index data representing a dot pattern in the dot patterning process is 4-bit data as in the high quality picture mode but contains information on five gradation levels.

The processing performed by the print data creation J0006, which involves adding print control information to the print image information containing the 4-bit index data to generate the print data, is the same as in the high quality picture mode.

The printing apparatus performs the dot patterning process J0007 and the mask data conversion process J0008 an the incoming print data in the same way as in the high quality picture mode.

The dot patterning process J0007 of this embodiment during the high speed mode will be explained as follows. The dot patterning process during the high speed mode reduces the number of multi-value levels from five to two, generating binary information which determines the presence or absence of a dot. More specifically, for each pixel represented by 4-bit data of gradation level 0-4 output from the half toning process, a dot pattern that matches the gradation level 0-4 of the pixel is assigned. Based on the dot pattern assigned, dot-on or dot-off information is defined in each of pixel elements in the pixel of interest by assigning 1-bit ejection data "1" or "0" to each pixel element.

Figure 7:
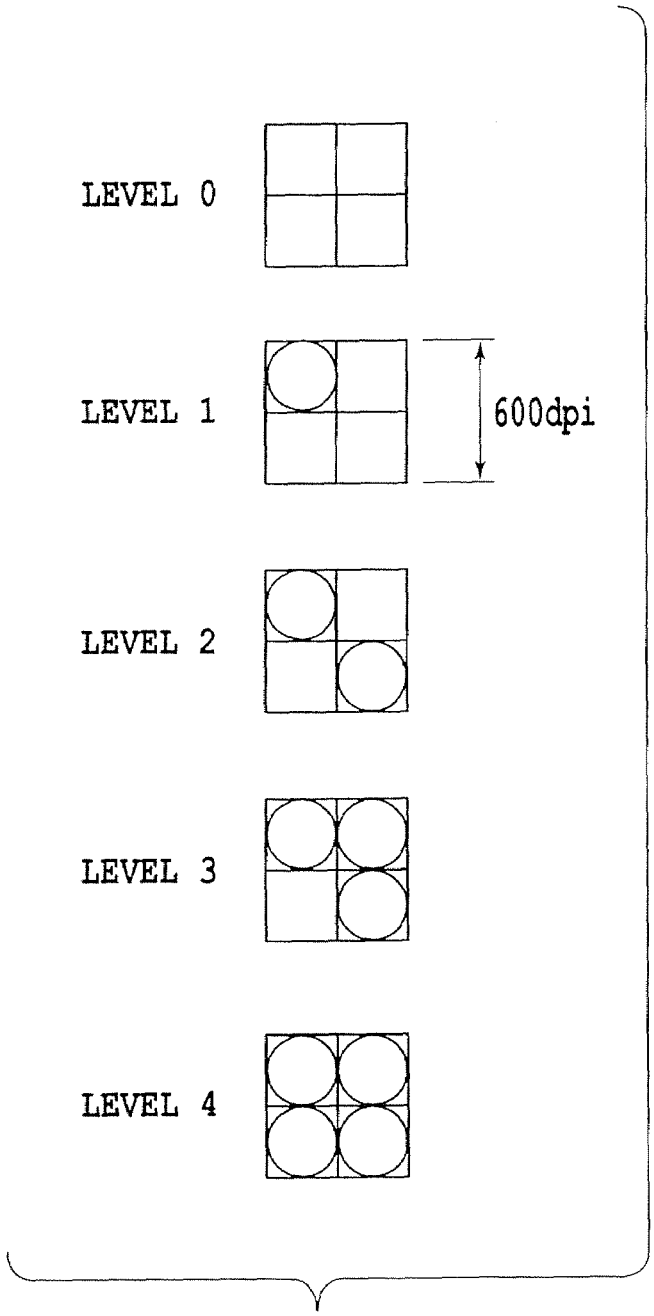
FIG. 7 illustrates a dot patterning process performed during a high speed mode in the embodiment of this invention, showing output patterns for input levels 0-4.

FIG. 7 shows output patterns converted from input levels 0-4 by the dot patterning process for the high speed mode of this embodiment. The levels shown at left correspond to the output values, level 0 to level 4, from the half toning process. A 2×2 matrix area shown at right corresponds to an area of one pixel output from the half toning process. In the high quality picture mode, each pixel of 600 ppi output from the half toning process is printed with dots at a dot density of 1200 dpi (dots/inch; reference value) in vertical direction and 2400 dpi in horizontal direction. In the high speed mode, on the other hand, each pixel of 600 ppi is composed of an area measuring two pixel elements in vertical direction and two pixel elements in horizontal direction.

Further, the high speed mode does not adopt the arrangement of FIG. 4 used for the high quality picture mode, in which a plurality of different dot patterns are cyclically assigned to different pixel positions of the same level. The high speed mode assigns only one dot pattern to each level without regard the pixel position.

As described above, since in the high speed mode of this embodiment the pattern areas are small, measuring only 2×2 pixel elements and the number of patterns used for each level is only one, the memory area to store the dot patterns can be made smaller than when the high quality picture mode is used.

Now, the mask data conversion process J0008 of this embodiment during the high speed mode will be explained.

It is assumed that the high speed mode of this embodiment uses a 3-pass printing.

Figure 8:
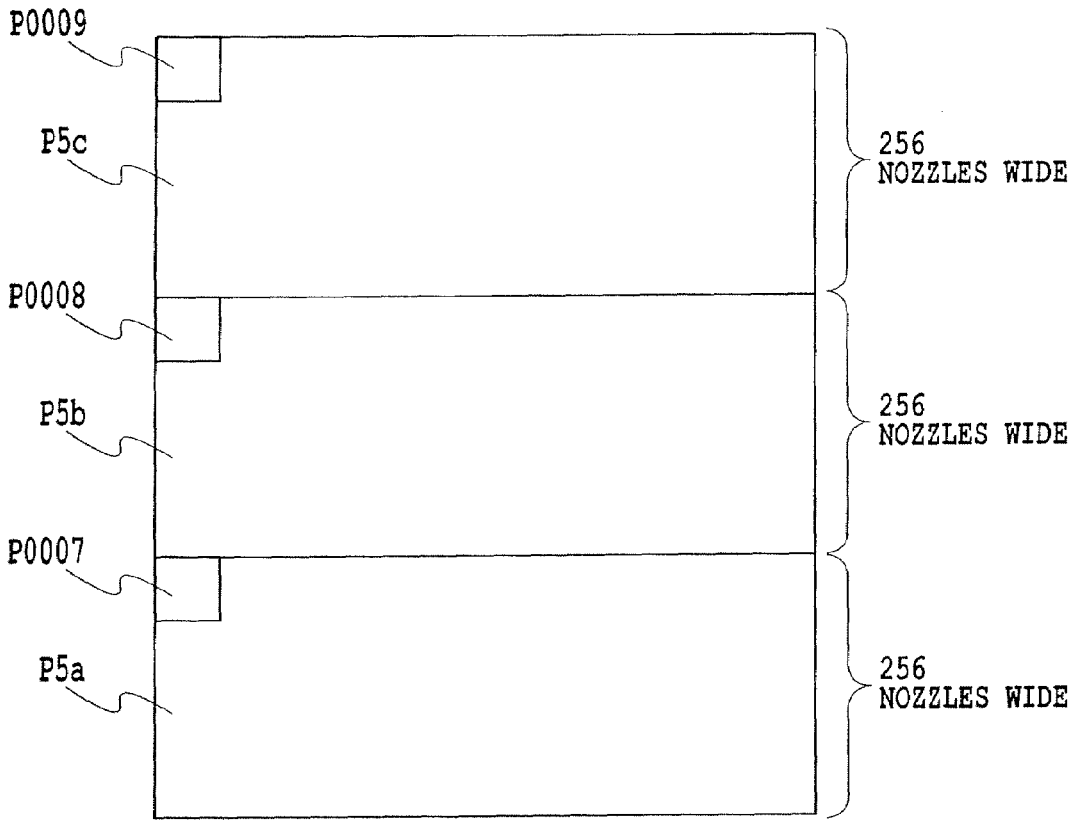
FIG. 8 illustrates a mask pattern actually applied to a high speed mode in the embodiment of this invention.

FIG. 8 shows a mask pattern actually applied to the high speed mode of this embodiment. The print head J0010 used in this embodiment has 768 nozzles. Since a 3-pass printing is performed, 768 nozzles are divided into three groups of 256 nozzles each. The mask pattern therefore measures 768 pixel elements in the vertical direction, equal to the number of nozzles, and 386 pixel elements in the horizontal direction. Thus, the mask pattern is divided into three areas P5*a*, P5*b*, P5*c* corresponding to the three nozzle groups. Setting the feed distance (subscan distance), by which the print medium is fed following one main scan of the print head, to the width of 256 nozzles enables a print area corresponding to the 256-nozzle width to be main-scanned by the print head three times. In the high speed mode of this embodiment, each nozzle group prints at a 50% duty and superimposing the printing operations of the three nozzle groups results in a 150% printing. The print data is thinned by the mask patterns P5*a*, P5*b*, P5*c* of FIG. 8 but their detailed patterns are not shown in the figure, with only parts of the patterns P5*a*, P5*b*, P5*c* shown in FIG. 9.

A purpose and an arrangement of the 150% printing are explained in detail as follows. In the high speed mode of this embodiment as described above, the dot patterning process explained in FIG. 7 can print up to only four dots in an area represented by one pixel output from the half toning J0005. However, as already explained in the high quality picture mode, the printing apparatus of this embodiment is designed to print up to eight dots or eight small drops of 2 pl in one pixel. Therefore, if printing is done in high speed mode by applying only four dots to one pixel, an image formed has an insufficient dot density. This embodiment compensates for the lack of dot density during the high speed mode by a new mask data conversion process.

Figure 9:
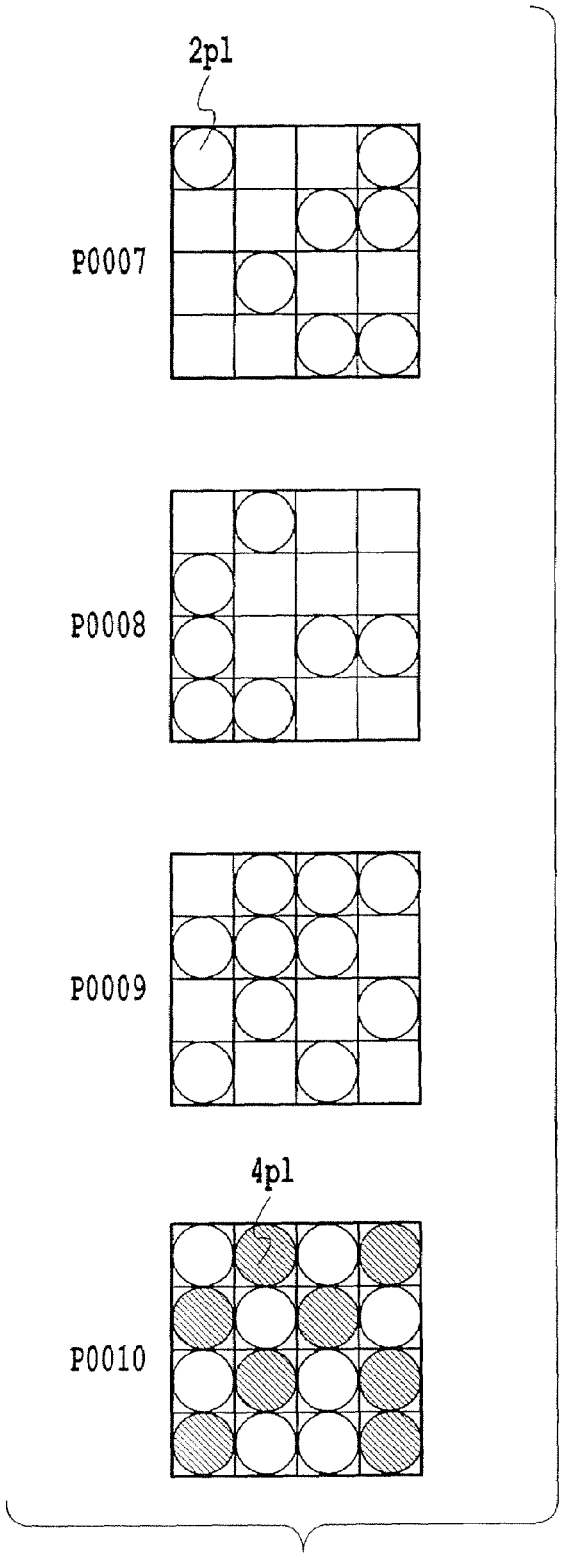
FIG. 9 is an enlarged view of 4×4 element areas each located at an upper left corner of a scan area for the corresponding group of nozzles shown in FIG. 8.

FIG. 9 shows an enlarged view of areas P0007-P0009 of 4×4 pixel elements in FIG. 8 located at the upper left corner of the areas corresponding to the nozzle groups. These three pattern areas P0007-P0009 are superimposed on the print medium for printing and a resultant pattern is shown at P0010. In the mask patterns P0007-P0009, portions marked with a white circle represent pixel element areas to which an ink droplet of 2 pl is applied during the printing scan, In P0010 the white circle portions are pixel elements where one 2-pl dot is printed and black circle portions are those where two 2-pl dots are applied, i.e., 4 pl of ink is printed. As shown in P0010, black circles and white circles are arranged staggered. Therefore, the dot arrangements in one pixel area or 2×2-pixel element area are all similar and up to six dots can be formed.

Figure 10:
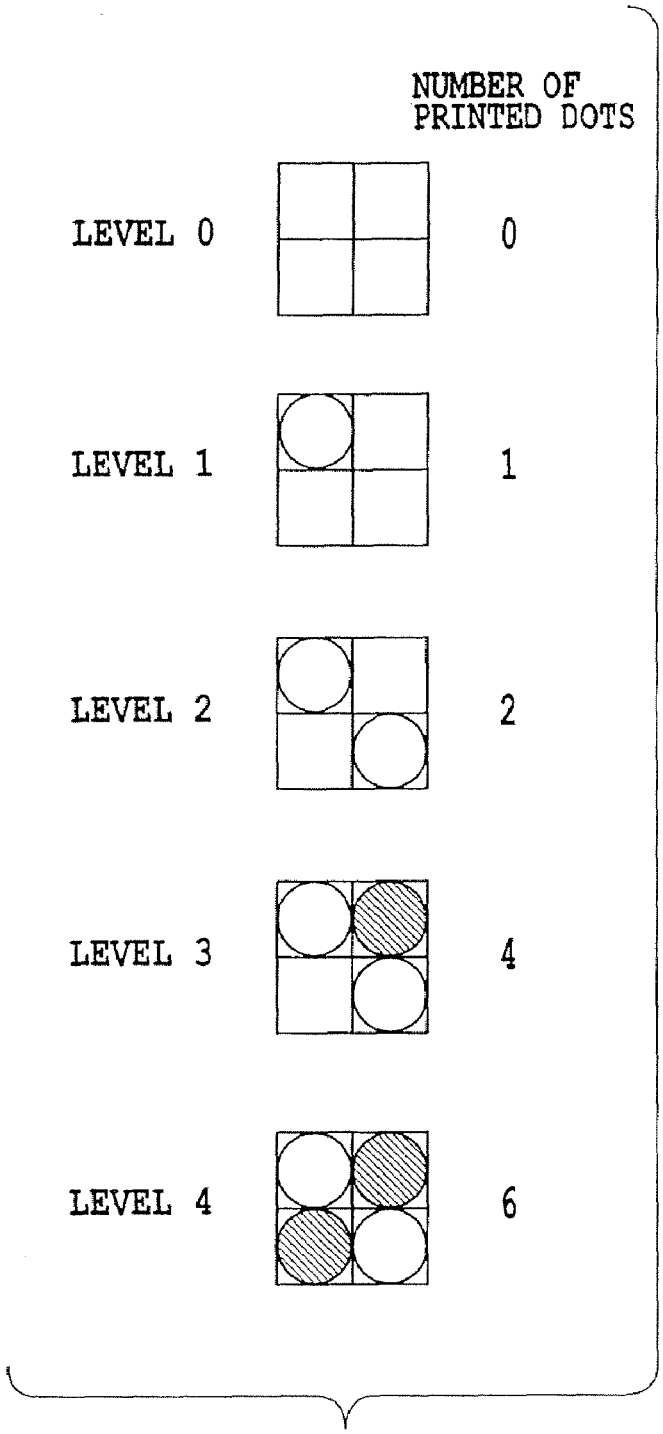
FIG. 10 illustrates dot arrangements and the number of dots printed for the input levels 0-4 of FIG. 7.

FIG. 10 shows dot arrangements and the number of dots printed for the input levels 0-4 of FIG. 7. In the figure, white circles represent pixel element areas where one 2-pl ink droplet is printed and black circles represent pixel element areas where two 2-pl ink droplets are printed. Blank portions represent pixel element areas where no ink droplets are applied. As shown in the figure, for level 0 to level 2, one dot is added as the level increments by one. However, for level 3 and level 4, two dots are added as the level increments by one. Generally in low gradation regions the problem of graininess is given a higher priority in the ink jet printing apparatus and thus the emphasis of dots should be avoided as much as possible. In high gradation regions the addition of one dot or so hardly increases the density and, in addition, it is desired that the maximum density be set as high as possible. Therefore, in this embodiment, an arrangement is made such that the number of dots to be added is increased as the density goes high and that up to six dots can be printed in one pixel.

It should be noted, however, that the number of dots does not in any way limit this invention. It is possible to add two dots at a time beginning with the low level. The total number of printed dots in one pixel may be six dots or more. If the number of printed dots at the maximum density is set equal to that of the high quality picture mode, it is desired that eight dots be printed at level 4. However, in a mode that places importance on the image quality, such as high quality picture mode, print mediums with a glossiness and a large ink accommodating capacity are often used. In a high speed mode that prints documents including tables and texts, on the other hand, print mediums that do not have so large an ink accommodating capacity, such as plain paper, are often used. Therefore, the high speed mode of this embodiment is arranged to use not as large an amount of ink as that of the high quality picture mode.

No matter what the number of dots is set to, the intended effect of this invention can be produced as long as the dots printed are more (or less) than the number of pixel elements determined by the dot patterning process and the number of dots corresponding to each level can be uniquely determined in the dot patterning process. With this arrangement the output patterns can be made to match the input levels in a one-to-one correspondence and, for each input level, a dot pattern can be obtained which has emphasis dots added in an appropriate condition. When viewed the other way, it is possible to perform the preceding processing (i.e., from the precedent process to the half toning) on condition that the dot patterns emphasized as shown in FIG. 10 will be output.

Returning back to FIG. 3, 1-bit data processed by the mask data conversion process J0008 is sent to the print head drive circuit J0009 where it is further converted into a drive pulse for the print head J0010, which then ejects ink at predetermined timings.

As described above, in an ink jet printing apparatus which sets a dot density so that a desired gradation level is achieved by using small ink droplets of 2 pl, this embodiment provides a high speed mode for printing an image at a lower dot density and also a mask data conversion process which can produce a desired gradation level even in the high speed mode. An image produced by the mask patterns is characterized in that the gradation level in one pixel after the half toning processing maintains a desired linearity.

Next, a second embodiment of this invention will be described. In the first embodiment described above, the high speed mode is set as a mode that uses a lower dot density than that of the high quality picture mode. In this embodiment the high quality picture mode is realized at the same dot density as the first embodiment while using smaller ink droplets.

In this embodiment, it is assumed that the flow of image data conversion process, which was explained with reference to FIG. 3, can also be applied. It is noted, however, that the ink jet printing apparatus of this embodiment uses only four color inks, cyan, magenta, yellow and black, excluding light cyan and light magenta. Thus, the subsequent process J0003 converts RGB 8-bit data into CMYK 8-bit data and the subsequent processing processes the four color data for C, M, Y and K.

In the half toning J0005, as in the high quality picture mode of the first embodiment, a quantization of converting 8-bit color separation data into 4-bit data is executed by a multivalue error diffusion method to transform 256 gradation levels into 9 gradation levels.

It is noted, however, that the print head J0010 of this embodiment ejects ink droplets of about 1 pl. Setting small the ink volume ejected from the print head, i.e., the size of dots formed on the print medium in this way can make a graininess at low duties less noticeable.

If printing is done in the same way as the high quality picture mode of the first embodiment, with dots set smaller as described above, the amount of ink applied becomes insufficient, giving rise to a problem of gradation level falling below what is expected. In such a case, a conventional practice increases the dot density according to the size of dots formed. However, setting a higher dot resolution in the printing apparatus requires improvements in the print position accuracy and print medium transport accuracy and also an increased capacity of data processing including dot patterning process, making the apparatus costly. On the contrary, the picture quality required in the market does not put much importance on the resolution as long as the graininess is eliminated to some extent and a predetermined tonality and density are secured. Therefore, this embodiment attempts to realize the high quality picture mode by reducing the ink droplets to 1 pl to mitigate graininess and still using the same printing apparatus as in the first embodiment without increasing the dot density and printing precision.

Also in the high quality picture mode of this embodiment, the dot patterning process J0007 can use the dot patterns shown in FIG. 4. That is, in an area of each of the pixels arranged at 600 ppi in vertical and horizontal directions and output as 9-value data from the half toning process, ink droplets of 1 pl are printed at a dot density of 1200 dpi in the vertical direction and 2400 dpi in the horizontal direction.

In the high quality picture mode of this embodiment, it is assumed that a 4-pass printing is performed. Although a mask pattern applied in this case is not shown, it is 768 nozzles high and divided into four areas corresponding to the four groups of 192 nozzles, as in the case of FIG. 6. In the mask used in this embodiment, the areas covered by the four nozzle groups are each printed at a 50% duty and superimposing the areas printed by each nozzle group results in a 200% printing.

Figure 11:
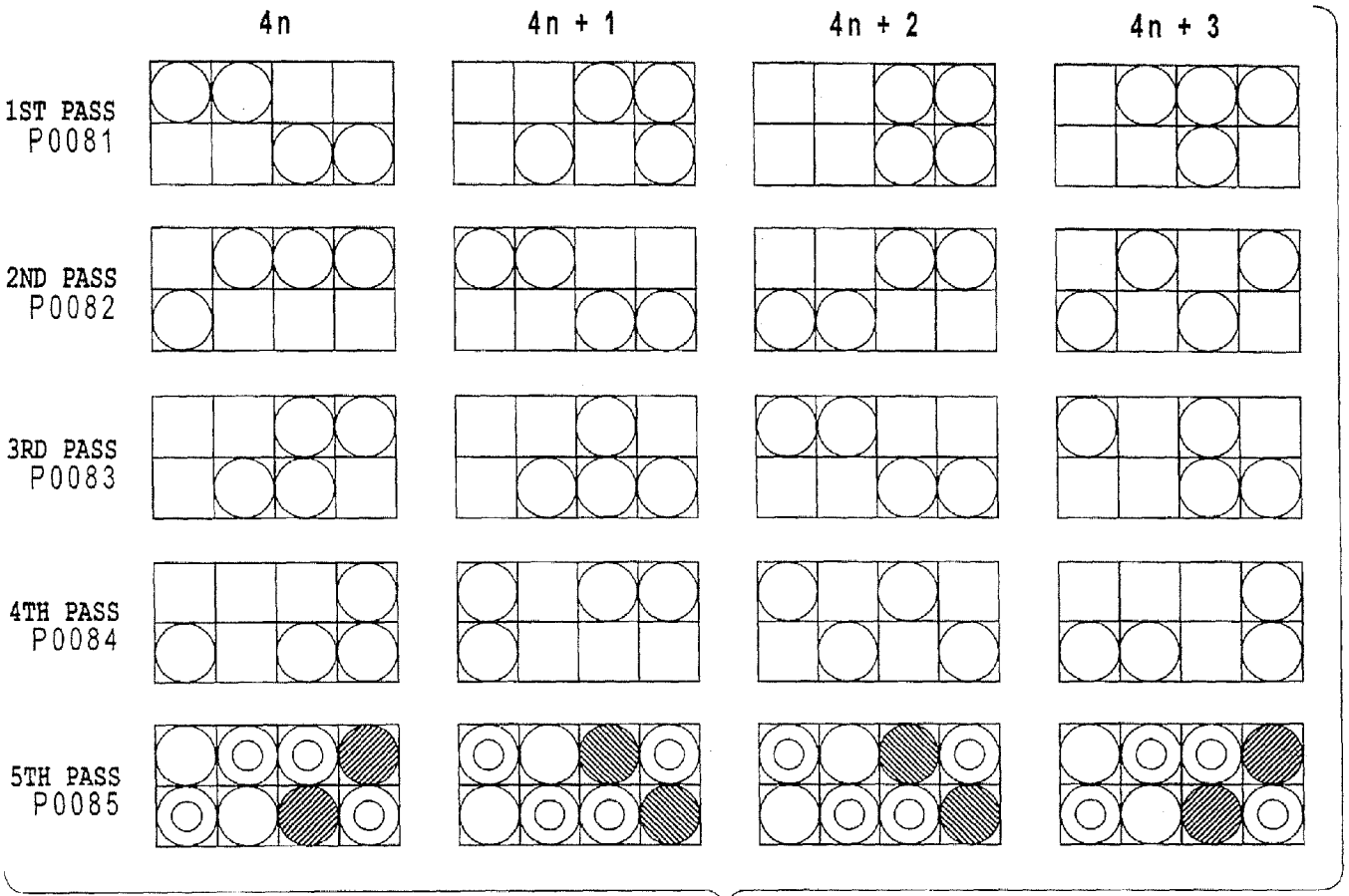
FIG. 11 illustrates 2×16 element areas each located at an upper left corner of a 4-pass mask pattern in the embodiment of this invention.

FIG. 11 shows areas of 2×16 pixel elements situated at an upper left of 4-pass mask patterns covered by the four nozzle groups, in a manner similar to FIG. 9. These four areas P0081-P0084 are superimposed on the print medium for printing and a resultant pattern is shown at P0085. In P0081-P0084, white circle portions represent pixel element areas to which an ink droplet of 1 pl is applied during the printing scan. In P0085, white circle portions represent pixel element areas where one 1-pl dot is printed; double circle portions represent pixel element areas where two 1-pl dots or 2 pl of ink are printed; and black circle portions represent pixel element areas where three 1-pl dots or 3 pl of ink are printed. The black circle portions, double circle portions and white circle portions are arrayed such that, as shown at P0085, a 1-pixel area or 2×4-pixel element area is printed with up to 16 dots.

Further, like the pixel element array marked (4n) to (4n+3) in FIG. 4, the pattern of FIG. 11 provides an array of different patterns that are cyclically assigned to different pixel positions. Thus, the 2×4-pixel element areas can be treated as 1-pixel areas to represent the gradation level output from the half toning process.

Figure 12:
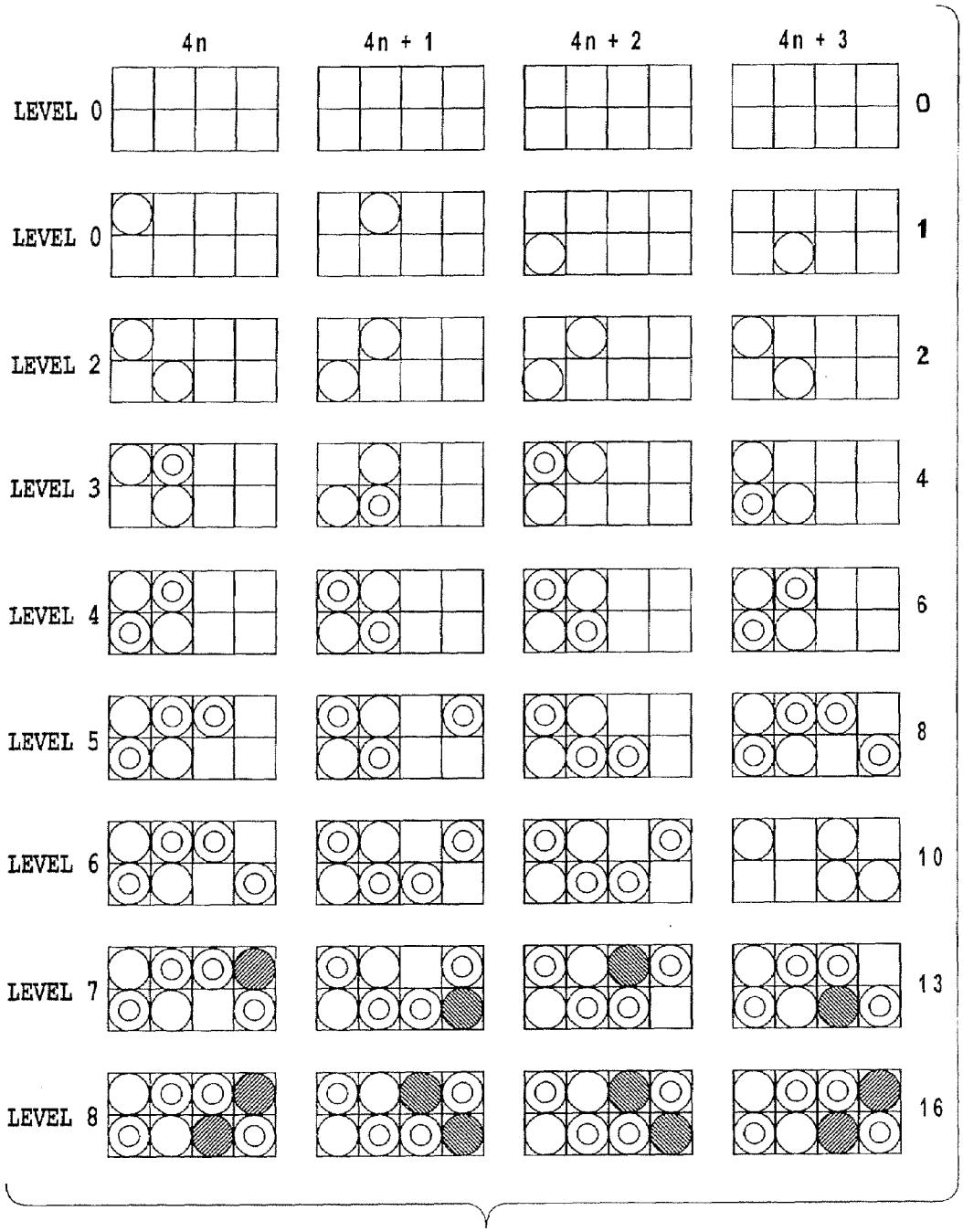
FIG. 12 illustrates printed dot arrangements and the number of dots printed in one pixel area for the input levels 0-8 of FIG. 4.

FIG. 12 shows dot arrangements and the number of dots printed in one pixel area for the input levels 0-8 of FIG. 4. In the figure, white circle portions represent pixel element areas where one 1-pl ink droplet is applied; double circle portions represent pixel element areas where two 1-pl ink droplets are applied; black circle portions represent pixel element areas where three 1-pl ink droplets are applied; and blank portions represent pixel element areas where no ink droplets are printed. As shown in the figure, at level 0 to level 2, one dot is added as the level increments by one. However, at level 3 to level 6, two dots are added as the level increments by one Further, at level 7 and level 8, three dots are added as the level increments by one.

As described in the first embodiment, in areas with low gradation levels, a high priority is placed on the problem of graininess in the ink jet printing apparatus, so it is desired that dot emphasis be avoided as much as possible. As the gradation level increases, the addition of one dot or so becomes less likely to raise the density and it is desired that the maximum density be set as high as possible. Therefore, in this embodiment, an arrangement is made such that the number of dots to be added is increased as the density goes high and that up to 16 dots can be printed in one pixel at a final stage. It should be noted, however, that this configuration does not limit this embodiment. As long as the number of dots printed in one pixel area increases linearly according to the gradation level output from the half toning process, this invention and this embodiment are effective, no matter how many dots are printed in one pixel area in whatever arrangement.

As in the first embodiment, 1-bit data processed by the mask data conversion process J0008 is sent to the print head drive circuit J0009 where it is further converted into a drive pulse for the print head J0010, which then ejects ink at predetermined timings.

As described above, in an ink jet printing apparatus which sets a dot density so that a desired gradation level is achieved by using ink droplets of 2 pl, this embodiment can reduce the ink ejection volume to 1 pl and still alleviate graininess at low duties without using light cyan and light magenta inks. To compensate for the reduction in the ejection volume to 1 pl, this embodiment provides a mask pattern corresponding to such dot patterns as shown in FIG. 6 which allows the printed dot patterns to maintain an appropriate linearity with the gradation level of one pixel and also allows one pixel area to be printed with up to 16 pl of ink at a final stage, equivalent to the ink ejection volume realized in the high quality picture mode of the first embodiment. As a result, an image with a high quality required of a picture printing can be obtained by performing a smaller volume of data processing than in the first embodiment.

When a print head used can hardly modulate the ink ejection volume as described above, this construction produces an effect as if the printing is performed by a print head capable of modulation from 1 pl to 16 pl. Further, since the 16-pl printing is done by a plurality of printing scans each ejecting some volume of ink from different nozzles, a more preferable image can be produced. A print head capable of modulating the ink ejection volume is indeed difficult to construct by arraying nozzles at such a high density as in this embodiment, because of its structure. Therefore, the fact that the present invention enables the print head with high density nozzles to perform printing as if it can modulate the ink ejection volume is preferable in terms of both the printing speed and the image quality.

The mask pattern applied in this invention is not limited to what has been described in the above embodiments. This invention is effective as long as the number of dots printed in one pixel by a plurality of printing scans matches a gradation level determined by the half toning process. Thus, the positions of dots printed by the printing scans may be arranged in any desired configuration. The mask patterns used by individual printing scans may, for example, be regularly arranged patterns that are cyclically shifted as shown in FIG. 5 or randomly arranged patterns such as disclosed in Japanese Patent Application Laid-open No. 5-155040. Further, this invention is also effectively applied to mask patterns disclosed in Japanese Patent Publication No. 06-47290 (cone mask) in which dots are arranged in a way that has a predetermined dispersion characteristic.

A technique for performing an emphasized printing on the same area by applying multipass mask patterns to input data is already disclosed (Japanese Patent Application Laid-open No. 05-278232). The disclosed conventional emphasized printing randomly determines dots to be emphasized, by applying a mask pattern to a binarized dot pattern or dot arrangement. That is, in the construction employed by the printing apparatus of this embodiment, in which multi-valued gradation data produced by the half toning is further processed by the dot patterning process to generate dot patterns representing optimal gradation levels, the emphasis printing is performed totally irrespective of the dot pattern in one pixel area. Hence, the multi-valued gradation data assigned to one pixel loses its significance. This invention, to the contrary, considers a dot pattern corresponding to the multi-valued gradation data assigned to one pixel in creating a mask pattern and thus can perform a linearly emphasized printing equally for every pixel. Therefore, the multi-valued gradation data assigned to one pixel maintains its significance.

Automated Print Medium Check System

Next, an automated check system used in this embodiment to identify the kind of print medium will be explained.

The ink jet printing apparatus of this embodiment has an optical print medium check member installed in a print medium feed mechanism not shown, so that a check is automatically made beforehand to determine if the print medium is plain paper or photographic paper.

Figure 13:
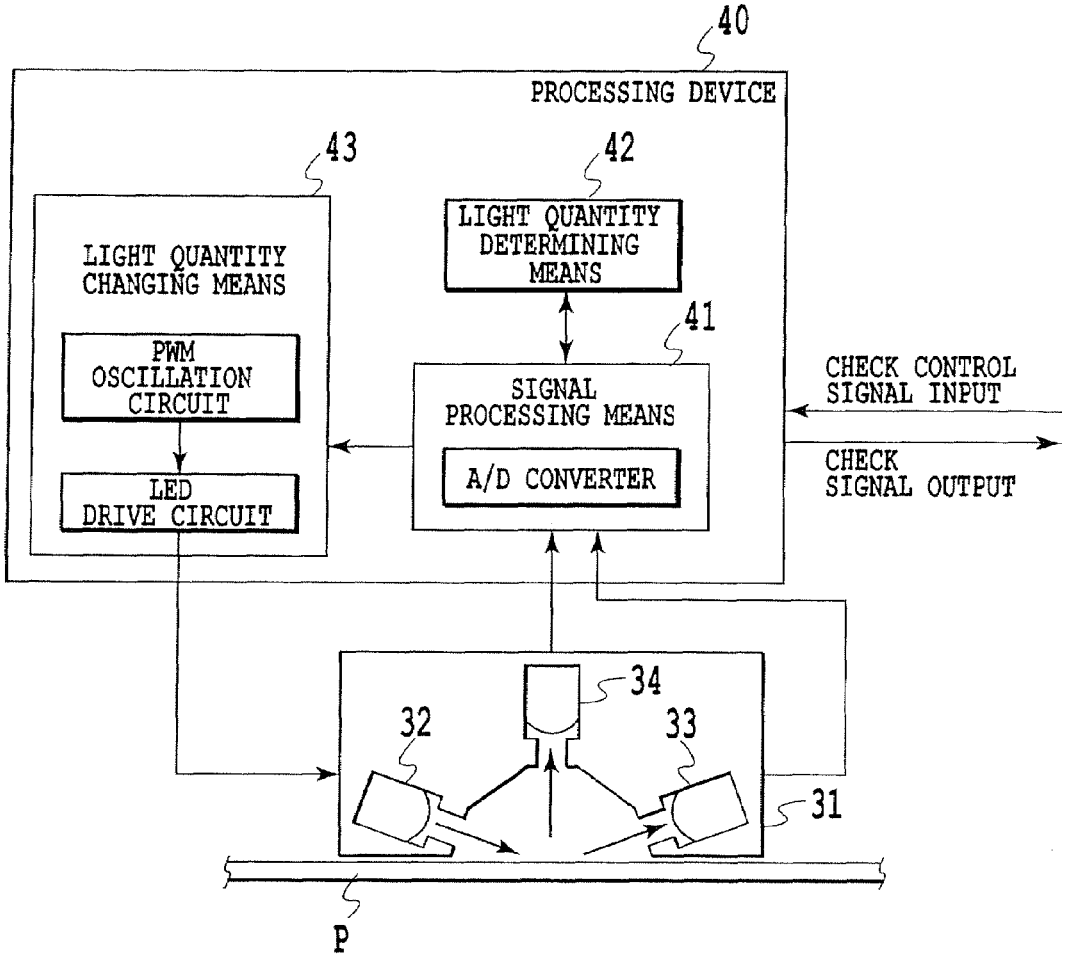
FIG. 13 is a block diagram showing an automated check system in the embodiment of this invention.

FIG. 13 shows a configuration of the automated check system.

As shown in the figure, the check system comprises a light detection unit 31 made up of a light source and an optoelectric transducer, and a processing device 40 which processes a signal from a sensor head to identify the kind of print medium This check system is also referred to as a print medium checking device.

The light detection unit 31 includes an LED 32 as a light source and sensors that detect and measure a quantity of light reflected from the LED by using an optoelectric transducer such as photodiode. The sensors for detecting the reflected light quantity includes a specularly reflected light sensor 33 that detects light (specularly reflected light) reflected at an angle equal to an angle of incidence of the light emitted from the LED 32 with respect to the print medium P, and a diffusely reflected light sensor 34 that detects light (diffusely reflected light) reflected at an angle different from the incidence angle of the light emitted from the LED 32 with respect to the print medium P. Here, the print medium P includes paper, cloth, plastic films and various other materials and also a reflection reference sheet that provides a reference for determining a threshold to identify the kind of print medium. Further, the print medium P also includes another reflection reference sheet used for calibrating the light detection unit 31.

The processing device 40 includes a signal processing means 41 to process an output signal from the light detection unit 31 through an A/D converter; a light quantity determination means 42 to determine a light quantity of the LED 32 in the light detection unit 31; and a light quantity changing means 43 to cause the LED 32 to emit the light quantity determined by the light quantity determination means 42 and change the light quantity of the LED 32 to determine the light quantity to be used during the detection process. The signal processing means 41 includes an A/D converter and a calculation unit. The A/D converter converts an analog signal representing the light quantity detected by the light detection unit 31 into a digital signal. The calculation unit performs a predetermined correction calculation on the digital signal output from the A/D converter and outputs a detection value that corresponds to the reflected light quantity from the light detection unit 31 and which is used to identify the kind of print medium used.

The light quantity determination means 42 has a storage unit, a comparison unit and a calculation unit. Here, based on a relation between the light quantity of LED 32 used during calibration of the light detection unit 31 and the detected value from the signal processing means 41, the light quantity determination means 42 determines a light quantity to be emitted from the LED 32 that is used to identify the kind of print medium and then stores the determined value in the storage unit. The light quantity changing means 43 has a PWM oscillation circuit and an LED drive circuit. The light quantity changing means 43 changes the light quantity emitted from the LED 32 when performing calibration of the light detection unit 31 or identifying the kind of print medium. More specifically, during the calibration of the light detection unit 31, the light quantity changing means 43 changes the light quantity from the LED 32 by modulating the PWM supplied to the LED drive circuit and measures the light quantity received by the specularly reflected light sensor 33 and the diffusely reflected light sensor 34 (detected values obtained in the signal processing means 41) until they reach preset values. Performing this calibration on the light detection unit 31 can minimize detection errors due to variations in sensor detection sensitivity which are the product of the light quantity of the LED 32 as a light source and the light reception sensitivity of the sensors such as specularly reflected light sensor 33 and diffusely reflected light sensor 34.

Figure 14:
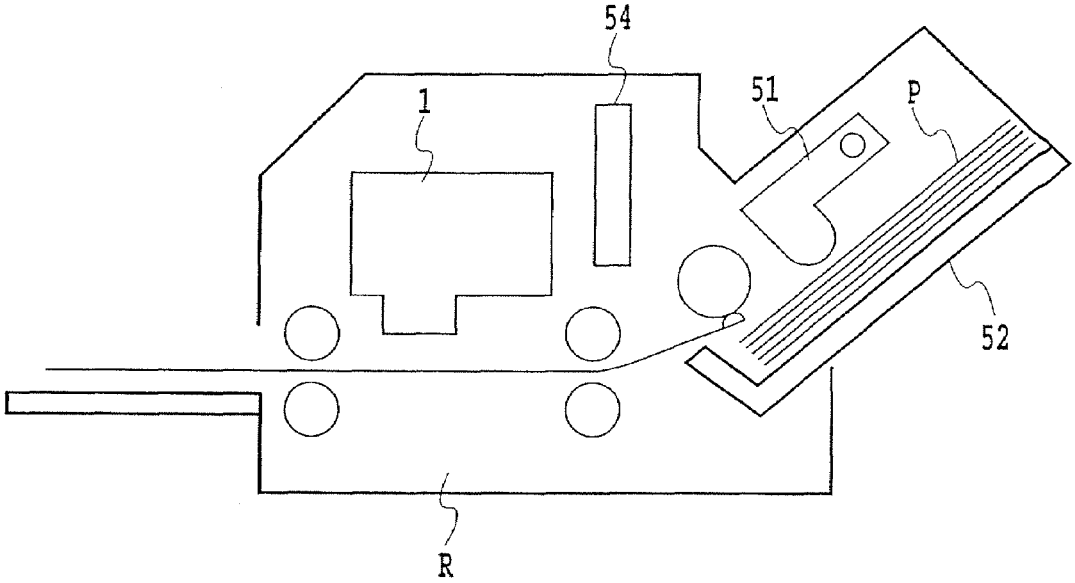
FIG. 14 is a cross-sectional view showing an essential portion of a printing apparatus incorporating the automated check system in the embodiment of this invention.

FIG. 14 shows a cross-sectional view of an essential part of the printing apparatus equipped with an example print medium checking device for identifying the kind of print medium.

In the figure, denoted 51 is an arm carrying the light detection unit 31. Designated 52 is a paper stacking unit in which print medium sheets P are stacked. This arm 51 is situated to oppose the paper stacking unit 52 to determine the kind of print medium sheets P on the paper stacking unit 52. When no sheets are stacked on the paper stacking unit 52, the light detection unit 31 may be calibrated. A printed circuit board 54 includes a part or all of the processing device 40 shown in FIG. 13 and performs checking on the kind of print medium and control on the printing operation. Designated 1 is a print head and R a transport path through which the print medium is transported as it is printed.

Figure 15:
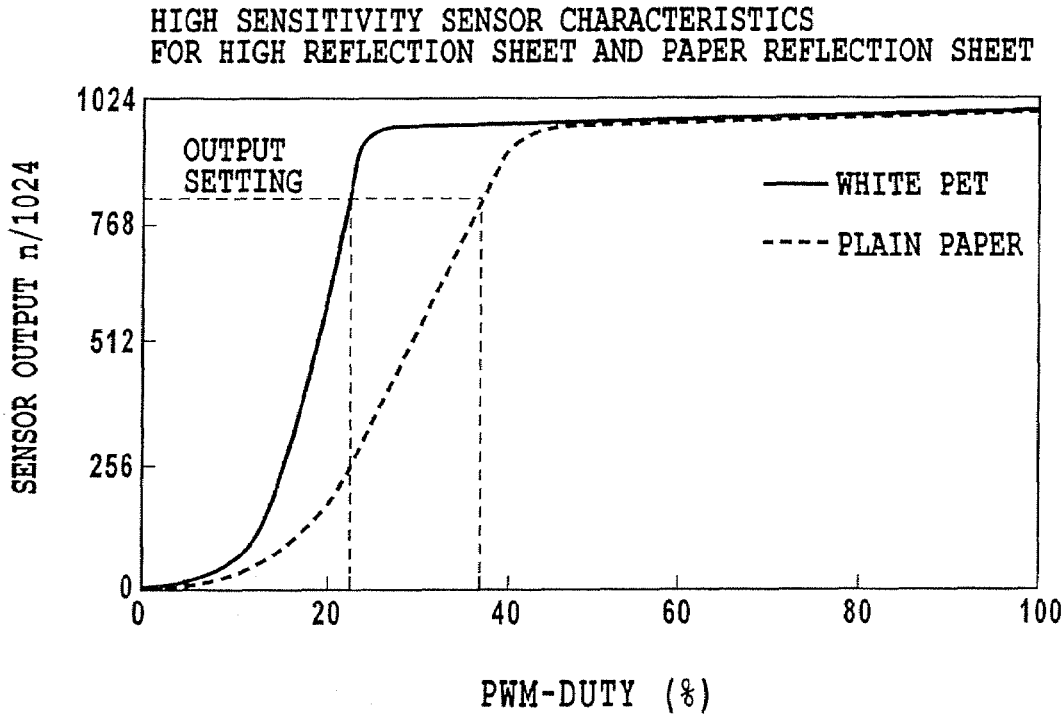
FIG. 15 is a graph showing a relation between an amount of light emitted from a light source and an output of a sensor when the automated check system of FIG. 13 detects print mediums with different reflectivities.

FIG. 15 shows a relation between a light quantity applied to print mediums with different reflectivities and an output from the sensor.

FIG. 15 shows a result of measurement of reflected light. Measurements were taken by radiating light against a print medium with a relatively high reflectivity (white PET sheet) and a print medium with a relatively low reflectivity (plain paper). This graph shows characteristics of specularly reflected light quantities detected by a highly sensitive sensor. It is seen from FIG. 15 that, for a preset sensor output of 800, the PWM drive duty for white PET sheet is 24% and the PWM duty for plain paper is 38%. The preset sensor output is also referred to as a reference reflected light quantity in this specification. As described above, light quantities reflected from different kinds of print mediums with different reflectivities and therefore with different reflected light quantities can be determined by repeating the above-described operation. Based on the reflected light quantities thus determined, a plurality of reference reflected light quantities can be obtained. This invention provides a plurality of sets of thresholds based on these reference reflected light quantities to enable identification of the kind of print medium.

Figure 16:
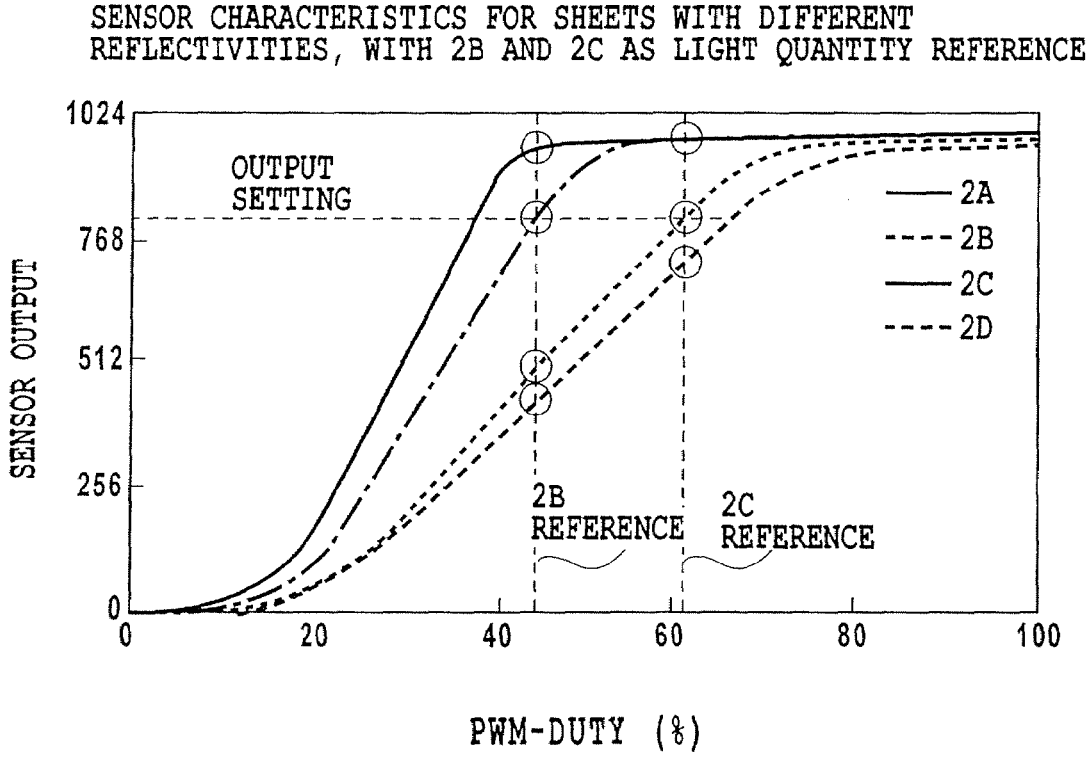
FIG. 16 is a graph showing a relation between an amount of light emitted from the light source and an output of the sensor when the automated check system of FIG. 13 detects print mediums with different reflectivities.

FIG. 16 shows a relation between a light quantity applied to print mediums with different reflectivities and an output from the sensor.

FIG. 16 shows reflected light quantities or characteristics of sensor output from four different print mediums PA, PB, PC, PD, arranged in the descending order of reflectivity. The quantity of light applied to the different print mediums is changed by changing the PWM drive duty of LED 32 as a light source.

In identifying the kind of print medium by using the processing device of FIG. 13, the first step is to determine a first set of threshold corresponding to the reference reflected light quantity. Here, a print medium PB is taken as a reflection reference sheet for determining the first set of threshold, and a PWM drive duty of the light source LED 32 that corresponds to the reference reflected light quantity from the print medium PB is determined. As shown in FIG. 16, for the reference reflected light quantity or sensor output of 800, the PWM drive duty of the light source LED 32 for the print medium PB is 45%. Next, a reflected light quantity or sensor output when light is radiated at PWM drive duty of 45% is determined. In FIG. 16, the sensor outputs from the print mediums PA, PC, PD when light is radiated at the PWM drive duty of 45% are 959, 497 and 439 respectively. These sensor outputs are 10-bit digital values.

Next, thresholds to identify the kind of print medium are determined.

Since the sensor outputs from print mediums PA, PB are 959 and 800 respectively, i.e., there is a difference in sensor output between them, the print mediums 2A, 2B can be distinguished by setting 900 in the range of 800 to 959 as a threshold G11. The same can be said of the distinction between print mediums PB and PC. 650 in the range of 497 to 800 is preferably set as a threshold G12. However, as to the print mediums PC and PD, since they have little difference between the sensor outputs of 497 and 493, provision of a threshold G13 between 439 and 497 may result in a failure to identify the print medium kind. This is because the sensor output produced even by the same kind of print mediums has a certain range of variation.

Therefore, when the sensor output difference is small as in the case with print mediums PC and PD, the light quantity of the light source LED 32 is changed and the sensor outputs are measured again to determine a second set of threshold.

With the print medium PC as a reflection reference sheet, a PWM drive duty of the light source LED 32 for the reference reflected light quantity is determined lo in a manner described above. As shown in FIG. 16, the PWM drive duty of LED 32 for the reference reflected light source of the print medium PC is 61%. When the light is radiated to the print mediums PA, PB, PD with the PWM drive duty of LED 32 set at 61%, their sensor outputs are 972, 967 and 708 respectively. Since the sensor outputs for the print mediums PC, PD are 800 and 708 and there is a sufficient difference between them, 755 in the range of between 708 and 800 can be set as a threshold G21.

Figure 17:
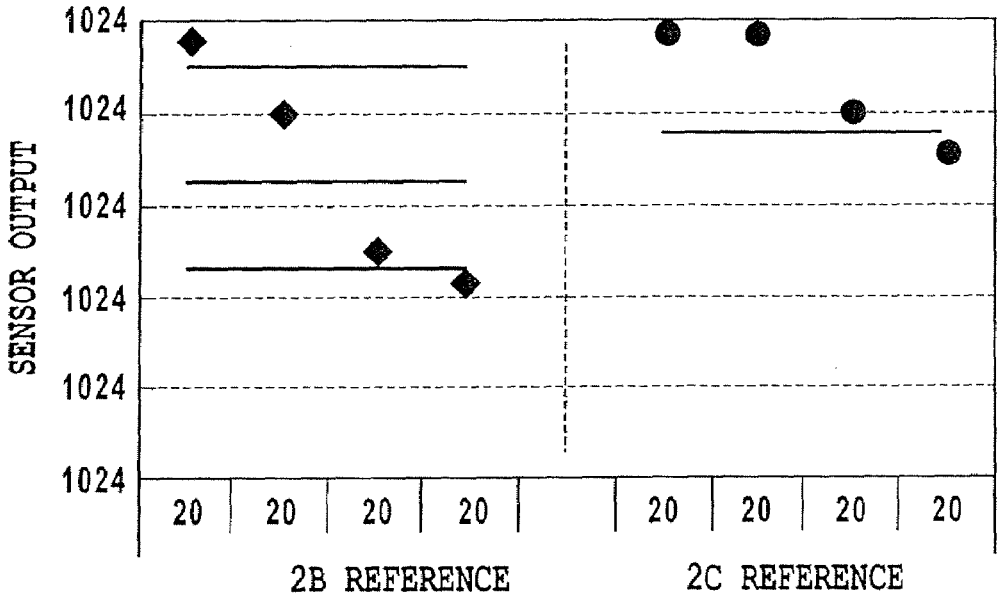
FIG. 17 is a graph showing sensor outputs for various print mediums when the light source of the automated check system of FIG. 13 Is driven at different duties.

By comparing the thresholds G11, G12, G21 with the sensor outputs from the light detection unit 31, the four kinds of print mediums PA-PD can be identified (see FIG. 17). Here, the left side of FIG. 17 represents sensor outputs of print mediums when the light source LED 32 is driven at the PWM drive duty of 45% with the print medium PB taken as a reflection reference sheet. Similarly, the right side of FIG. 17 represents sensor outputs of print mediums when the light source LED 32 is driven at the PWM drive duty of 61% with the print medium PC taken as a reflection reference sheet.

The print medium checking device to identify the kind of print medium operates in cooperation with other processing units in the printing apparatus and external devices connected to the printing apparatus, according to a check control signal input to and a check signal output from the processing device 40.

As described above, this embodiment identifies the kind of print medium by changing the light quantity to be applied from a light source to the print medium and comparing the sensor output for each emitted light quantity with thresholds. This arrangement permits a variety of print mediums with different reflection characteristics to be identified accurately.

Electric Power Energy Control

Next, an outline of an electric power energy control, which is characteristic of this embodiment, will be explained.

Here, explanations concern a monitoring of electric power energy consumption for the electric power energy control performed during the printing operation and also a electric power energy control method that is selectively executed during 1-pass bidirectional printing or 2-pass bidirectional printing according to the monitored electric power energy consumption.

First, a basic philosophy about the monitoring of power energy consumption that is executed to decide whether or not to perform the electric power energy control will be explained. A main objective of the electric power energy control is to ensure that, in an ink jet printing apparatus with the power cost and size designed for general consumers, a printing operation can be performed while maintaining the minimum required speed without degrading the image quality whatever image data is input. Thus, the printing apparatus is designed so that not all of the nozzles arrayed in the print head are activated simultaneously.

The electric power energy control in this embodiment is executed when a preset power threshold required for the printing operation is exceeded. The operation basically includes providing a power halt time when the printing action is not performed or reducing the printing speed or the number of nozzles used for printing, in order to reduce an average power consumption to restore electricity supplied from a power supply circuit to a level required the printing operation.

The electric power energy control is not performed in all print modes but only in a part of the print modes that consumes a large amount of power. In an ink jet printing apparatus using six color inks (black, cyan, magenta, yellow, light cyan and light magenta), an operation of the electric power energy control will be explained for an example case where each of the six print heads has 768 nozzles, i.e., printing is done by using a total of 4608 nozzles.

The printing conditions covered by the electric power energy control include:

(a) Default mode for plain paper (2400 nozzles (1200 dpi), 4 colors, 2-pass bidirectional printing: default);

(b) High speed mode for plain paper (1200 nozzles (600 dpi), 4 colors, 1-pass bidirectional printing: 50% thinned printing);

(c) Economy mode for plain paper (1200 nozzles (600 dpi), 4 colors, 1-pass bidirectional printing: 25% thinned printing);

(d) Default mode for photographic paper (six colors, 4-pass bidirectional printing); and (e) High speed mode for photographic paper (six colors, 3-pass bidirectional printing)

Among print modes for which the electric power energy control is not performed are:

(f) High quality mode for plain paper (2400 nozzles (1200 dpi), six colors, 8-pass bidirectional printing: custom printing); and (g) High quality mode for photographic paper (4800 nozzles (2400 dpi), six colors, 8-pass bidirectional printing)

As to the method of determining whether or not to execute the electric power energy control, there are two methods, a check method 1 and a check method 2.

The check method 1 counts, from among print data stored in print buffers 21Y, 21M, 21C, 21Bk, 21LC, 21LM provided for the respective color inks, the number of print dots stored in a predetermined check area in each of the print buffers, and compares the dot count with a preset dot number (threshold 1) for each print mode. If the threshold 1 is exceeded by the dot count in the check area of even one color, a decision is made that dictates the execution of the electric power energy control described later. This count operation and the decision are done by the CPU 210. In this embodiment, the check area has a size measuring 768 dots (equal to the nozzle number) in the vertical direction (nozzle array direction) and 2 inches (1200 dots×2=2400 dots) in the horizontal direction (head scan direction).

If the dot count in this check area exceeds the threshold 1 for even one color, the electric power energy control described later is executed. That is, in (a) default mode for plain paper, 45% of the total number of dots printed in the check area is set as a threshold and, whenever this threshold is exceeded, the electric power energy control is performed. In other print modes, an appropriate percentage of the total number of dots that can be printed in the check area is set as a threshold, e.g., 60% for (b) high speed mode for plain paper, 60% for (a) economy mode for plain paper, 50% for (d) default mode for photographic paper, and 50% for high speed mode for photographic paper. When any of these thresholds is exceeded, the electric power energy control is brought into operation.

Further, this embodiment provides a second method, check method 2, to determine whether or not to execute the electric power energy control. The check method 2 has a different purpose than that of check method 1.

The check method 2 checks if a total number of dots of all colors to be printed that are stored in the check areas of predetermined size has exceeded a preset dot number (threshold 2). In this embodiment, the printing conditions for which the check method 2 is performed include: (a) default mode for plain paper, (b) high speed mode for plain paper and (c) economy mode for plain paper.

This embodiment, for example, counts the number of dots to be printed in the check area in the print buffer of each color and, if a total of counts of all the print buffers is greater than the threshold 2, executes the electric power energy control described later. In this example, the check area has a size measuring 768 dots (equal to the nozzle number) in the vertical direction (nozzle array direction) and 2 inches (1200×2=2400 dots) in the horizontal direction (head scan direction).

The threshold 2 is preset for each print mode. In (a) default mode for plain paper, the electric power energy control is activated when 300% of the total dot number in the check areas is exceeded. In other print modes, too, appropriate thresholds are set. With respect to the total number of dots to be printed in the check areas, 300% is set in (b) high speed mode for plain paper and 300% in (c) economy mode for plain paper.

In this control, when determining the total dot count for all colors, it is necessary to count the number of nozzles used on the identical check areas during the actual scan. That is, the positions of the check areas of different colors must not deviate from one another. In performing a registration adjustment, the check areas must be set by considering the above requirement. Therefore, for a precise dot count, the print buffers are provided with a window that is set by considering position information for each color and registration adjustment information.

Next, how the electric power energy control to be executed in this embodiment is selected will be explained.

In this embodiment, the automated check system can identify the kind of print medium prior to starting the printing operation and, based on the identified print medium kind, the user can select a desired print mode from among the high speed, standard and high quality modes and start printing.

Image data supplied from a host device such as personal computer is processed according to the image processing flow described above and converted into 4- or 6-color print data which is then stored in print buffers. Then, according to the result of the check method 1 or check method 2, i.e., the result of decision as to whether the electric power energy control should be executed or not, the electric power energy control is performed as the printing operation proceeds.

When print information such as characters downloaded from the Web is being printed on plain paper in a high speed mode (print mode (b) described above), if the threshold 1 or threshold 2 is exceeded, the electric power energy control shifts the printing operation to the one that limits the number of nozzles used (e.g., divided printing operation described later). Further, when photograph data output from a digital camera is being printed on photographic paper in a default mode (print mode (d) described above), if the threshold 1 or threshold 2 Is exceeded, the electric power energy control shifts the printing operation to the one that inserts a halt time between the successive printing scans (average printing time control). That is, in this embodiment, if the check method 1 or check method 2 has decided that the electric power energy control should be executed, an appropriate electric power energy control is selected from among different electric power energy controls (here, a divided printing operation and an average printing time control) according to the printing operation condition determined by the kind of print medium and the print mode being executed.

Here, the reason that a different electric power energy control is selected for a different kind of print medium is briefly described as follows. In a print medium in which dots of ink easily spread along fibers of the print medium, like plain paper, the ink dot is unstable in shape and tends to be large in diameter, increasing the overlapping range between the dots. Further, since the surface of the plain paper is rough, the density distribution of ink dots is moderate, reducing a difference in density between a portion where dots overlap and a portion where they do not. Therefore, density variations that look like stripes and are caused by deflections of ink droplets ejected from end nozzles of the print head become less noticeable. However, since the overlapping portions of dots widen, the ink drying condition varies from one part of the printed image to another, producing density variations. Thus, in the printing operation on a print medium that easily spreads ink, a electric power energy control based on the divided printing that increases the number of passes in the multipass printing is more suited than the electric power energy control using the halt time (average electric power energy control).

On the other hand, in a print medium having a coated layer for accepting ink, like photographic paper, ink dots do not easily spread but have stable shape and small diameters. Thus, the dot overlapping range decreases, making the density distribution steep and increasing a density difference between a portion where dots overlap and a portion where they do not. As a result, density variations that appear like stripes and are caused by deflections of ink droplets ejected from the end nozzles of the print head become easily noticeable. Therefore, when printing is done at high duty in general as when printing a photographic image, simply performing the divided printing renders white stripes more easily noticeable because the ink droplets ejected from the end nozzles are deflected by an air flow, as described in the explanation on the mask design used for the multipass printing. However, when a photographic image is printed at high duty, the dot overlapping range becomes small, reducing density variations caused by ink drying condition variations. Therefore, when performing a high duty printing, an image can be formed properly by performing the electric power energy control (average printing time control) that provides a halt time between successive printing scans as described above, rather than executing the divided printing control that increases the number of passes. Thus, when performing the electric power energy control during a high duty printing, this embodiment automatically selects the average printing time control.

Next, examples of the divided printing and the average printing time control as the electric power energy control executed in this embodiment will be explained in detail.

Figure 18:
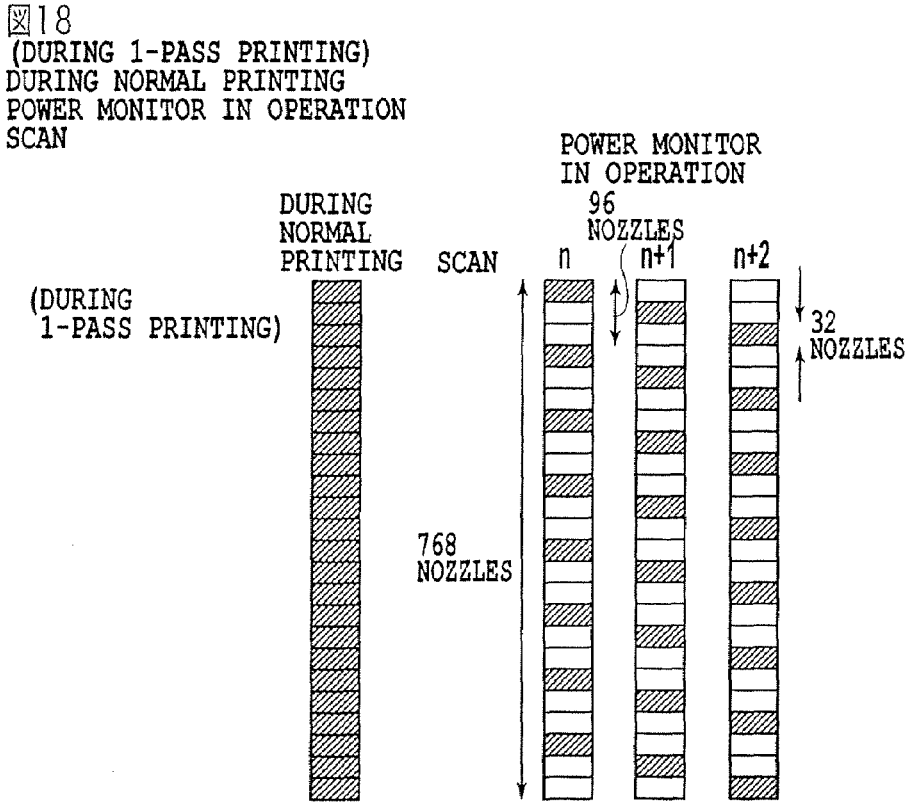
FIG. 18 is a schematic diagram showing a divided printing method performed during a 1-pass printing in the embodiment of this invention.
Figure 19:
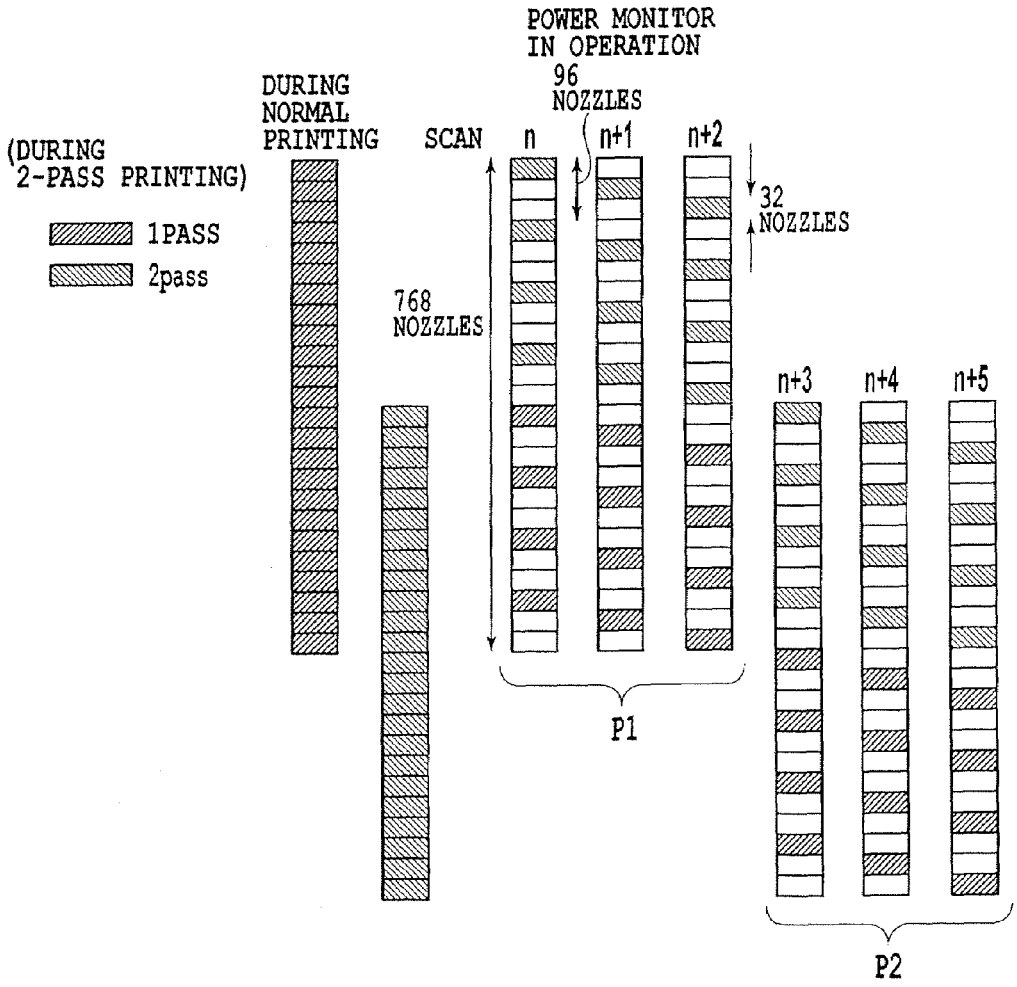
FIG. 19 is a schematic diagram showing a divided printing method performed during a 2-pass printing in the embodiment of this invention.

FIG. 18 and FIG. 19 show how the divided printing of this embodiment that limits the number of nozzles used is performed. FIG. 18 represents a divided printing performed during the 1-pass printing operation and FIG. 19 a divided printing performed during the 2-pass printing operation.

In the 1-pass printing operation performed during (a) high speed mode for plain paper and (b) economy mode for plain paper, when the check method 1 decides that the count value of dots to be printed in the check area does not exceed the threshold 1, all the nozzles of each print head (here 768 nozzles) are used to print all print data on one scan area of each print head in one scan operation. On the other hand, when the check method 1 decides that the count value of dots to be printed in the check area has exceeded the threshold 1 and that a electric power energy control needs to be executed, print data that is normally printed by the 1-pass printing is divided and printed in three scans n, n+1, n+2 that are not accompanied by the feed operation of the print medium. Division is done by dividing 768 nozzles into 24 blocks of 32 nozzles and the first scan (n) uses eight blocks, i.e., 1st to 32nd nozzle, 97th to 128th nozzle, . . . , 673rd to 704th nozzle. Next, the second scan (n+1) uses another eight blocks, 33rd to 64th nozzle, 129th to 160th nozzle, . . . , 705th to 736th nozzle, for printing. The last third scan (n+2) uses still another eight blocks, 65th to 96th nozzle, 161st to 192nd nozzle, . . . , 737th to 768th nozzle, for printing. During the first to third scan the print medium is not fed.

Next, the divided printing control during the 2-pass printing operation performed as in the default mode for plain paper will be explained by referring to FIG. 19.

During the 2-pass printing operation, if the check method 1 decides that the count value of dots to be printed in the check area does not exceed the threshold 1, the normal 2-pass printing operation is performed. That is, in the normal 2-pass printing, the nozzles of the print head (here 768 nozzles) are divided into two groups and the print medium is fed between the two scans of the print head (between first pass and second pass). As a result, a print area corresponding to the width of one nozzle group is printed with print data using different nozzle groups.

When on the other hand it is decided that the count value of dots to be printed in the check area has exceeded the threshold 1, two blocks of print data, that are normally printed in the first pass P1 and the second pass P2 of the 2-pass printing, are each divided and printed in three scans P1 (n, n+1, n+2) and P2 (n+3, n+4, n+5) respectively. Division is done, as in the 1-pass printing, by dividing each of the first and second pass nozzle group, 768 nozzles each, into 24 blocks of 32 nozzles. The first scan (n) in the first pass uses eight nozzle blocks, i.e., 1st to 32nd nozzle, 97th to 128th nozzle, . . . , 673rd to 704th nozzle, for printing. Next the second scan (n+1) uses another eight blocks, 33rd to 64th nozzle, 129th to 160th nozzle, . . . , 705th to 736th nozzle, for printing. The last third scan (n+2) uses still another eight blocks, 65th to 96th nozzle, 161st to 192nd nozzle, . . . , 737th to 768th nozzle, for printing. At this time, the print medium is fed a distance corresponding to the width of the one nozzle group (384 nozzles wide). Then, the fourth scan (n+3) in the second pass uses eight blocks, i.e., 1st to 32nd nozzle, 97th to 128th nozzle, . . . , 673rd to 704th nozzle. Next, the fifth scan (n+4) uses another eight blocks, 33rd to 64th nozzle, 129th to 160th nozzle, . . . , 705th to 736th nozzle, for printing The last sixth scan (n+5) uses still another eight blocks, 65th to 96th nozzle, 161st to 192nd nozzle, . . . , 737th to 768th nozzle, for printing. Now the above process is finished.

By performing the divided printing operation as described above, print data which is normally printed by 1-pass printing in one scan area is divided and printed in three passes; and also two blocks of print data which are normally printed by 2-pass printing are each divided and printed in three passes. Thus, the power consumption in each scan can be reduced and still an image of satisfactory quality can be formed.

Next, the average printing time control, another electric power energy control used in this embodiment, will be explained.

In this embodiment, a non-printing time between successive scans of the print head is controlled to control the average printing time required for a printing operation. In a printing operation using photographic paper, when printing is performed at such a high duty that the count value of dots in the check area exceeds the threshold 1, the amount of electricity supplied from the power supply circuit may fall below the required level. So, a halt time is inserted between the current scan and the next scan to prolong the average printing time. As a result, during the halt time, the power supply circuit has its charging portions (mainly capacitors) charged to the normal level and thus can supply a sufficient amount of electricity for the next printing scan. Further, this average printing time control enables a high quality image to be formed even during a high duty printing without being influenced by the deflections of ink droplets ejected from the end nozzles.

For such an average printing time control, this embodiment sets the threshold 1 such that the power supply circuit can supply enough electricity during normal printing on photographic paper. When a printing operation is performed at a duty in excess of the threshold 1, i.e., when a power insufficiency is likely to occur, the halt time is inserted. However, setting the halt time longer than necessary may result in a cockling caused by a print medium soaking ink (waving phenomenon) and in density variations. In this embodiment, therefore, the halt time is set at 100 ms. Considering the printing time of one scan (8 inch wide): Tr (about 500 ms), the carriage ramp up time (or medium feed time): Tud (about 100 ms), and the halt time: Tw (about 100 ms), the non-printing time is set at about 200 ms. This setting secures an enough time to recover the power supply capability of the power supply circuit.

OTHER EMBODIMENTS

While the above embodiment has described a case where the kind of print medium is automatically detected by an optical sensor. It is noted, however, that the invention is not limited to this arrangement. For example, the user may specify the kind of print medium by using a general print medium selection function of the printer driver or by using a means for marking a print medium beforehand.

The print medium checking device is also not limited to the above embodiment and may employ other configurations. For example, two sensors using visible and ultraviolet light may be used to automatically detect a variety of special paper (gloss, semi-gloss, matte, etc.) in addition to the two kinds of popular print mediums, plain paper and photographic paper. It is also possible to select an optimal electric power energy control and printing method for the detected print medium. While the above embodiment has taken plain paper and photographic paper as example print mediums and described that they have different characteristics, it is known that the print medium characteristic varies from one print medium to another. That is, the print medium characteristic includes various elements such as an ink receiving capacity, absorption speed, color characteristic, density characteristic, density variation over time, dot shape, dot size, dot density distribution, and color variations. The printing method should preferably be selected according to these elements. Therefore, the detection and specifying of the kind of print medium will become increasingly important.

Further, while in the above embodiment the widow size for power control (vertical and horizontal dimensions and color of window) is set to a fixed value, the size may of course be changed adaptively according to image information for finer control.

Further, although the average time control method has been described for an example case of controlling the halt time between successive scans, it is also possible to control the average time of the printing operation by changing the drive frequency of the nozzles to reduce the printing speed. That is, when photographic paper is used, the power supply needs to be controlled in a way that allows the nozzles to perform their ink ejection function to the full extent, rather than executing a control such as divided printing method that will change the printing method itself.

Further, explanations in the above embodiment have centered around the control of eliminating the possibility of insufficient power supply to the print head, the printing capability of the print head may also be lost because of a lack of the capability to supply a sufficient amount of ink to the nozzles. That is, since the amount of ink that can be supplied from an ink tank to the nozzles in a predetermined time (ink supply capability) is determined beforehand, if ink is ejected from the nozzles in a volume exceeding this ink supply capability, the ink supply to the nozzles becomes insufficient. In this embodiment, when image data is input which requires ink ejection in excess of the ink supply volume of 1.5 g/min, the ink supply from the tank to the print head falls below the requirement. This results in a reduced ejection volume and a faint image and, in a worse case, a failure to eject ink, which in turn causes degradations of printed image quality. For example, if ink droplets of 2 pl are ejected from 768 nozzles at 20 kHz for each color, the ink ejection volume during one second is 1.8 g/min, which exceeds the ink supply capability of the ink tank of 1.5 g/min. In that case, an ink flow control also needs to be executed in a way similar to the electric power energy control.

When the ink ejection volume exceeds a predetermined value, a control to limit the ink ejection volume is performed to maintain an appropriate state of ink ejection from the nozzles. This ink ejection volume control is realized by selecting a printing control similar to the electric power energy control. That is, the number of nozzle operations in the print head in a predetermined time duration needs to be controlled. However, since the ink supply capability of the ink tank is restored to a different state under a different condition including a total ink flow and an ink flow per unit time, as in the case of the power supply circuit, a control to recover the normal state by inserting a halt time as in the electric power energy control, i.e., an average print time control, should preferably be executed.

In the above embodiment an example case has been explained in which the number of nozzles to be driven in the check area or the ink ejection volume is determined and a check is made as to whether the number of nozzles to be operated or the ink ejection volume is larger than a predetermined threshold and in which, if it is larger than the threshold, the printing operation is performed according to the divided printing method that uses a preset number of divisions or the average printing time changing method that inserts a preset halt time. In addition to checking whether the number of driven nozzles or ink ejection volume is greater than the threshold, it is also possible to determine a difference between the number of driven nozzles or ink ejection volume and the threshold and, based on the difference, to change the number of divisions (a feed distance in a single feed operation by the feeding means and the number of nozzles driven in one scan period) in the divided printing method or change a prolonged time of one scan period in the average printing time changing method. This allows for a more efficient electric power energy control or ink ejection volume control.

In this embodiment, an optimal electric power energy control or ink flow control is selected according to the kind of print medium or the printing method as described above. That is, in a plain paper print mode that puts importance on a fast printing using a relatively small number of colors (four colors or less) and a small number of passes (two passes or less) to cope with both image quality and high speed, when image data which would sharply and temporarily increase the number of print dots is printed, as when forming an image made up mostly of graphs and texts, quality degradations (stripes and density/color variations) do not easy occur and thus the divided printing is adopted. In a dedicated paper print mode that puts importance on a high quality printing using a relatively large number of colors (five colors or more) and a large number of passes (three passes or more), print data is mostly photographic images for which the average number of print dots is always a high duty. Thus, quality degradations (stripes and density/color variations) easily show. Therefore, by adopting the average printing time control that inserts a halt time and reduces a drive frequency, It is possible to effectively utilize the limited capacity of the power supply and the limited capability of the ink supply unit even during the high-resolution (1200 dpi or higher), high-speed (10 kHz or higher) ink jet printing operation using a large number of nozzles (512 nozzles or more). Therefore, a high-quality image printing with little throughput degradation can be realized.

The present invention has been described in detail with respect to preferred embodiments, and it will now be apparent from the foregoing to those skilled in the art that changes and modifications may be made without departing from the invention in its broader aspects, and it is the intention, therefore, that the appended claims cover all such changes and modifications.

This application claims priority from Japanese Patent Application No. 2004-251080 filed Aug. 30, 2004, which is hereby incorporated by reference herein.

What is claimed is:

1. An ink jet printing apparatus having scan means for causing a print head to scan in a predetermined scan direction, the print head having a plurality of printing elements to convert electric energy into ink ejection energy, and a transport means for transporting a print medium in a direction crossing the scan direction of the print head, the ink jet printing apparatus comprising:

drive means for driving a plurality of printing elements of the print head;

setting means for setting a printing condition of a printing operation;

operation number detection means for detecting the number of printing element operations executed by the drive means in a predetermined check area set in one scan area of the print head;

decision means for checking if a detected value produced by the operation number detection means is larger than a predetermined threshold;

first changing means for changing a set value of the number of printing element operations in one scan period of the print head;

second changing means for changing one scan period from when the print head starts the printing scan until the next printing scan is started; and control means for, when the decision means decides that the detected value is larger than the threshold, selecting either the first changing means or the second changing means according to the printing condition set by the setting means and causing the printing operation to be executed.

2. An ink jet printing apparatus according to claim 1, wherein the setting means sets a kind of print medium and a print mode as the printing condition.

3. An ink jet printing apparatus according to claim 2, wherein the setting means selectively sets one of a high speed print mode, a standard print mode and a high quality print mode.

4. An ink jet printing apparatus according to claim 2 or 3, wherein the setting means has automated identification means to radiate light against the print medium used and, based on a reflected light, automatically identify the kind of print medium.

5. An ink jet printing apparatus according to claim 4, wherein the automated identification means uses a visible light and an ultraviolet light to identify the kind of print medium.

6. An ink jet printing apparatus according to claim 2, wherein, when the decision means decides that the detected value is larger than the threshold and that the kind of print medium set by the setting means is the one that easily spreads landing ink, the control means selects the divided printing method set by the first changing means and causes it to perform a printing operation; and when the decision means decides that the detected value is larger than the threshold and that the kind of print medium set by the setting means is the one that does not easily spread landing ink, the control means selects the average printing time change method set by the second changing means and causes it to perform a printing operation.

7. An ink jet printing apparatus according to claim 1, wherein a plurality of the print heads are provided;

the operation number detection means detects, for each print head, the number of printing element operations executed by the drive means in the predetermined check area set in one scan area of the print head;

the decision means checks if the detected value detected for each print head by the operation number detection means is larger than the threshold; and the control means, when the detected value for at least one print head is found to be larger than the threshold, selects either the first changing means or the second changing means according to the printing condition set by the setting means and causes the printing operation to be executed.

8. An ink jet printing apparatus according to claim 1, wherein a plurality of the print heads are provided;

the operation number detection means detects, for each print head, the number of printing element operations executed by the drive means in the predetermined check area set in one scan area of the print head;

the decision means checks if a total of the detected values detected for each print head by the operation number detection means is larger than the threshold; and the control means, when the total of the detected values is found to be larger than the threshold, selects either the first changing means or the second changing means according to the printing condition set by the setting means and causes the printing operation to be executed.

9. An ink jet printing apparatus according to claim 1, wherein the first changing means sets a divided printing method that prints one printing scan area in a plurality of scans; and the second changing means sets an average printing time change method that extends the one scan period.

10. An ink jet printing apparatus according to claim 1, wherein the second changing means changes at least one of a print head drive frequency and a non-printing time to change the one scan period.

11. An ink jet printing apparatus according to claim 1, wherein the decision means checks if the detected value produced by the operation number detection means is larger than the predetermined threshold and determines a difference between the detected value and the threshold;

the first changing means changes a feed distance that the transport means transports the print medium in one feed operation and the set value of the number of printing element operations in one scan period, according to the difference between the detected value produced by the operation number detection means and the threshold; and the second changing means changes the extended time of one scan period in the average printing time change method according to the difference between the detected value produced by the operation number detection means and the threshold.

12. An ink jet printing method that performs printing by using a print head having an array of printing elements to convert electric energy into ink ejection energy, driving the printing elements as the print head scans in a predetermined scan direction and transporting a print medium in a direction crossing the scan direction of the print head, the ink jet printing method comprising:

a driving step of driving a plurality of printing elements of the print head;

a setting step of setting a printing condition of a printing operation;

an operation number detecting step of detecting the number of printing element operations executed by the driving step in a predetermined check area set in one scan area of the print head;

a decision step of checking if a detected value produced by the operation number detecting step is larger than a predetermined threshold;

a first changing step of changing a set value of the number of printing element operations in one scan period of the print head;

a second changing step to change one scan period from when the print head starts the printing scan until the next printing scan is started; and a control step to, when the decision step decides that the detected value is larger than the threshold, select either the first changing step or the second changing step according to the printing condition set by the setting step and causing the printing operation to be executed.

13. An ink jet printing apparatus having scan means for causing a print head to scan in a predetermined scan direction, the print head having a plurality of printing elements to convert electric energy into ink ejection energy, and transport means for transporting a print medium in a direction crossing the scan direction of the print head, the ink jet printing apparatus comprising:

power supply means for generating electric energy to be supplied to the printing elements of the print head;

drive means for driving a plurality of printing elements of the print head by supplying the electric energy from the power supply means to the printing elements;

setting means for setting a printing condition of a printing operation;

operation number detection means for detecting the number of printing element operations executed by the drive means in a predetermined check area set in one scan area of the print head;

decision means for checking if a detected value produced by the operation number detection means is larger than a predetermined threshold;

first changing means for changing a set value of the number of printing element operations in one scan period of the print head;

second changing means for changing one scan period from when the print head starts the printing scan until the next printing scan is started; and control means for, when the decision means decides that the detected value is larger than the threshold, selecting either the first changing means or the second changing means according to the printing condition set by the setting means and causing the printing operation to be executed.

14. An ink jet printing apparatus having scan means for causing a print head to scan in a predetermined scan direction, the print head having a plurality of printing elements to convert electric energy into ink ejection energy, and transport means for transporting a print medium in a direction crossing the scan direction of the print head, the ink jet printing apparatus comprising:

an ink supply source for supplying ink to the printing elements of the print head;

drive means for driving a plurality of printing elements of the print head;

setting means for setting a printing condition of a printing operation;

ink volume detection means for detecting an ink volume to be ejected in a predetermined check area set in one scan area of the print head, according to the number of printing element operations executed by the drive means in the check area;

decision means for checking if a detected value produced by the ink volume detection means is larger than a predetermined threshold determined by an ink supply capability of the ink supply source;

first changing means for changing a set value of the number of printing element operations in one scan period of the print head;

second changing means for changing one scan period from when the print head starts the printing scan until the next printing scan is started; and control means for, when the decision means decides that the detected value is larger than the threshold, selecting either the first changing means or the second changing means according to the printing condition set by the setting means and causing the printing operation to be executed.

* * * * *

UNITED STATES PATENT AND TRADEMARK OFFICE

CERTIFICATE OF CORRECTION

PATENT NO. : 7,328,963 B2
APPLICATION NO. : 11/209848
DATED : February 12, 2008
INVENTOR(S) : Hiroshi Tajika et al.

It is certified that error appears in the above-identified patent and that said Letters Patent is hereby corrected as shown below:

TITLE PAGE:
In item "(56) References Cited," under "FOREIGN PATENT DOCUMENTS," the third-listed document, "JP 5-15540 6/1993" should be deleted.

COLUMN 7:
Line 67, "path" should read -- path. --.

COLUMN 9:
Line 30, "Informa-" should read -- informa- --.

COLUMN 10:
Line 55, "scan" should read -- scan. --.

COLUMN 15:
Line 51, "one" should read -- one. --.

COLUMN 24:
Line 66, "an" should be deleted.

COLUMN 25:
Line 3, "While the" should read -- The --.

COLUMN 27:
Line 12, "a" should be deleted.

Signed and Sealed this

Seventeenth Day of March, 2009

JOHN DOLL
*Acting Director of the United States Patent and Trademark Office*